US009388014B2

(12) United States Patent
Kato

(10) Patent No.: US 9,388,014 B2
(45) Date of Patent: Jul. 12, 2016

(54) LIQUID EJECTION APPARATUS

(71) Applicant: BROTHER KOGYO KABUSHIKI KAISHA, Nagoya-shi, Aichi-ken (JP)

(72) Inventor: Shigeki Kato, Toyoake (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/859,022

(22) Filed: Sep. 18, 2015

(65) Prior Publication Data

US 2016/0089909 A1 Mar. 31, 2016

(30) Foreign Application Priority Data

Sep. 30, 2014 (JP) ..... 2014-202036
Sep. 30, 2014 (JP) ..... 2014-202037

(51) Int. Cl.

| | |
|---|---|
| ***B41J 29/38*** | (2006.01) |
| ***B65H 31/30*** | (2006.01) |
| ***B41J 13/00*** | (2006.01) |
| ***B41J 13/10*** | (2006.01) |
| ***B65H 31/00*** | (2006.01) |

(52) U.S. Cl.

CPC ..... *B65H 31/3009* (2013.01); *B41J 13/0009* (2013.01); *B41J 13/0036* (2013.01); *B41J 13/106* (2013.01); *B65H 31/00* (2013.01); *B65H 31/3018* (2013.01)

(58) Field of Classification Search

CPC ..... B65H 31/00; B65H 31/3009; B65H 31/3018; B65H 29/34; B65H 29/26; B65H 31/26; B41J 13/106; B41J 13/0036; B41J 13/0009

See application file for complete search history.

(56) References Cited

U.S. PATENT DOCUMENTS

2013/0257957 A1* 10/2013 Itogawa ..... B41J 13/106 347/16

FOREIGN PATENT DOCUMENTS

JP 2003-246525 A 9/2003

* cited by examiner

*Primary Examiner* — Julian Huffman
(74) *Attorney, Agent, or Firm* — Merchant & Gould P.C.

(57) ABSTRACT

A liquid ejection apparatus includes: a liquid ejection head; a conveying mechanism; a holding mechanism for holding at least one recording medium between its first and second surfaces; a moving mechanism for moving the first surface; a reception tray disposed under the holding mechanism; and a controller. The controller is configured to: separate recording media to be recorded throughout one recording job, into recording-medium groups; control the conveying mechanism to convey the recording medium to a space between the first and second surfaces in each recording-medium group; acquire a waiting time in which each recording-medium group is to wait in the holding mechanism; and control the moving mechanism to move the first surface from a support position to a non-support position when a time elapsed from a timing when each recording-medium group has been conveyed to the holding mechanism reaches the waiting time.

20 Claims, 14 Drawing Sheets

FIRST TEMPORARY SEPARATING POSITION

| SHEET POSITION FROM UPPER SIDE | INDIVIDUAL WAITING TIME |
|---|---|
| 1 | 8 |
| 2 | 4 |
| 3 | 6 |
| ≀ | ≀ |
| 9 | 0 |
| 10 | 0 |

| | LAST PAGE OF SHEET GROUP | WAITING TIME | TOTAL WAITING TIME |
|---|---|---|---|
| FIRST TEMPORARY SEPARATING POSITION | 10 | 8 | 13 |
| | 30 | 5 | |
| SECOND TEMPORARY SEPARATING POSITION | 11 | 4 | 9 |
| | 30 | 5 | |
| ≀ | ≀ | ≀ | ≀ |
| ELEVENTH TEMPORARY SEPARATING POSITION | 20 | 8 | 13 |
| | 30 | 5 | |

FIG.10

| NUMBER OF PATTERNS | SEPARATING POSITION (SEPARATING PAGE NUMBER) | | | | | | | | | | | | | | | | | | | | | | | | | | | | | | | | | | | | | | | | | |
|---|---|---|---|---|---|---|---|---|---|---|---|---|---|---|---|---|---|---|---|---|---|---|---|---|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 31 | 32 | 33 | 34 | 35 | 36 | 37 | 38 | 39 | 40 |
| 2 | T1 | | | | | | | | | | | | | | | | | | | T2 | T2 | | | | | | | | | | | | | | | | | | | |
| 3 | | T1 | | | | | | | | | | | | | | | | | | T2 | T2 | T2 | | | | | | | | | | | | | | | | | | |
| 4 | | | T1 | | | | | | | | | | | | | | | | | T2 | T2 | T2 | T2 | | | | | | | | | | | | | | | | | |
| 5 | | | | T1 | | | | | | | | | | | | | | | | T2 | T2 | T2 | T2 | T2 | | | | | | | | | | | | | | | | |
| 6 | | | | | T1 | | | | | | | | | | | | | | | T2 | T2 | T2 | T2 | T2 | T2 | | | | | | | | | | | | | | | |
| 7 | | | | | | T1 | | | | | | | | | | | | | | T2 | T2 | T2 | T2 | T2 | T2 | T2 | | | | | | | | | | | | | | |
| 8 | | | | | | | T1 | | | | | | | | | | | | | T2 | T2 | T2 | T2 | T2 | T2 | T2 | T2 | | | | | | | | | | | | | |
| 9 | | | | | | | | T1 | | | | | | | | | | | | T2 | T2 | T2 | T2 | T2 | T2 | T2 | T2 | T2 | | | | | | | | | | | | |
| 10 | | | | | | | | | T1 | | | | | | | | | | | T2 | T2 | T2 | T2 | T2 | T2 | T2 | T2 | T2 | T2 | | | | | | | | | | | |
| 11 | | | | | | | | | | T1 | | | | | | | | | | T2 | T2 | T2 | T2 | T2 | T2 | T2 | T2 | T2 | T2 | T2 | | | | | | | | | | |
| 12 | | | | | | | | | | | T1 | | | | | | | | | T2 | T2 | T2 | T2 | T2 | T2 | T2 | T2 | T2 | T2 | T2 | T2 | | | | | | | | | |
| 13 | | | | | | | | | | | | T1 | | | | | | | | T2 | T2 | T2 | T2 | T2 | T2 | T2 | T2 | T2 | T2 | T2 | T2 | T2 | | | | | | | | |
| 14 | | | | | | | | | | | | | T1 | | | | | | | T2 | T2 | T2 | T2 | T2 | T2 | T2 | T2 | T2 | T2 | T2 | T2 | T2 | T2 | | | | | | | |
| 15 | | | | | | | | | | | | | | T1 | | | | | | T2 | T2 | T2 | T2 | T2 | T2 | T2 | T2 | T2 | T2 | T2 | T2 | T2 | T2 | T2 | | | | | | |
| 16 | | | | | | | | | | | | | | | T1 | | | | | T2 | T2 | T2 | T2 | T2 | T2 | T2 | T2 | T2 | T2 | T2 | T2 | T2 | T2 | T2 | T2 | | | | | |
| 17 | | | | | | | | | | | | | | | | T1 | | | | T2 | T2 | T2 | T2 | T2 | T2 | T2 | T2 | T2 | T2 | T2 | T2 | T2 | T2 | T2 | T2 | T2 | | | | |
| 18 | | | | | | | | | | | | | | | | | T1 | | | T2 | T2 | T2 | T2 | T2 | T2 | T2 | T2 | T2 | T2 | T2 | T2 | T2 | T2 | T2 | T2 | T2 | T2 | | | |
| 19 | | | | | | | | | | | | | | | | | | T1 | | T2 | T2 | T2 | T2 | T2 | T2 | T2 | T2 | T2 | T2 | T2 | T2 | T2 | T2 | T2 | T2 | T2 | T2 | T2 | | |
| 20 | | | | | | | | | | | | | | | | | | | T1 | T2 | T2 | T2 | T2 | T2 | T2 | T2 | T2 | T2 | T2 | T2 | T2 | T2 | T2 | T2 | T2 | T2 | T2 | T2 | T2 | |

FIG.14A

| SHEET POSITION FROM UPPER SIDE | INDIVIDUAL WAITING TIME |
|---|---|
| 1 | 8 |
| 2 | 4 |
| 3 | 6 |
| ≀ | ≀ |
| 19 | 0 |
| 20 | 0 |

FIG.14B

| LAST PAGE OF SHEET GROUP | WAITING TIME |
|---|---|
| 20 | 8 |
| 30 | 5 |

FIG.15

| SHEET POSITION FROM UPPER SIDE | 1 | 2 | 3 | 4 | 5... |
|---|---|---|---|---|---|
| COEFFICIENT Ca | 1 | 0.5 | 0.2 | 0.1 | 0 |

FIG.16

| INK AMOUNT (%) | 0 | 20 | 40 | 60 | 80 | 100 |
|---|---|---|---|---|---|---|
| COEFFICIENT Cb | 0 | 0.2 | 0.4 | 0.6 | 0.8 | 1 |

FIG.17

| SHEET POSITION FROM UPPER SIDE | 1 | 2 | 3 | 4 | 5 | 6... |
|---|---|---|---|---|---|---|
| COEFFICIENT Ca1 | 1.2 | 0.8 | 0.6 | 0.4 | 0.2 | 0 |

FIG.18

| INK AMOUNT (%) | 0 | 20 | 40 | 60 | 80 | 100 |
|---|---|---|---|---|---|---|
| COEFFICIENT Cb1 | 0 | 0.2 | 0.4 | 0.6 | 0.8 | 1 |

LIQUID EJECTION APPARATUS

CROSS REFERENCE TO RELATED APPLICATION

The present application claims priority from Japanese Patent Application Nos. 2014-202036 and 2014-202037 filed on Sep. 30, 2014, the disclosures of which are herein incorporated by reference in its entirety.

BACKGROUND

1. Technical Field

The following disclosure relates to a liquid ejection apparatus configured to eject liquid to record an image on a recording medium.

2. Description of the Related Art

There is known a sheet storage apparatus including: a storage tray for storing sheets as recording media; and a pair of sheet supporters, arranged over the storage tray, for temporarily supporting the sheets discharged by an output roller. Each of the pair of sheet supporters, having a three-sided rectangular shape, is constituted by a lower guide surface, a side guide, and an upper guide surface. The pair of sheet supporters are provided opposed to opposite sides of the sheet in a widthwise direction thereof. The pair of sheet supporters are movable between a first position at which the sheet supporters can support a lower side of the sheet and a second position at which the sheet supporters do not support the sheet. The pair of sheet supporters at the first position support the sheets discharged by the output roller and then are moved to the second position to drop (transfer) the sheets into the storage tray.

SUMMARY

In the sheet storage apparatus, for example, in the case where the pair of sheet supporters support the liquid-ejected sheets, even if the sheets are curled due to the ejected liquid during the support of the sheets by the sheet supporters, the lower guide surfaces and the upper guide surfaces of the sheet supporters restrain the curl to a height less than or equal to an allowable height of curl. The storage tray has no components for restraining the curl to a height less than or equal to the allowable height of curl. Thus, the curl of the sheets cannot be restrained after the sheets are stored in the storage tray. Accordingly, it is important how long the sheets are supported on the sheet supporters to suppress development of the curl on the storage tray.

Also, there is a demand for reducing a completion time extending from a start of image recording on the sheets to the completion of the transfer of the sheets to the storage tray while restraining the curl of the sheets to a height less than or equal to the allowable height of curl. However, it is not known how the sheets are separated for conveyance and how long the sheets are supported by the sheet supporters, in the case where the number of sheets is greater than the number of sheets supportable by the pair of sheet supporters, for example.

In the case where the liquid-ejected sheets are discharged onto the storage tray, for example, if the sheets are one by one supported on the pair of sheet supporters and then dropped into the storage tray, a waiting time for the sheets is calculated by multiplying a waiting time for one sheet by the number of the sheets, resulting in a considerably long time required from the start of image recording to the completion of the transfer of the sheets to the storage tray. In the above-described sheet storage apparatus, a plurality of sheets are supported by the pair of sheet supporters and dropped into the storage tray together with each other. However, it is not known how long the sheets are supported by the sheet supporters to reduce the time extending from the start of image recording the completion of the transfer of the sheets to the storage tray while suppressing the curl of the sheets.

Accordingly, an aspect of the disclosure relates to a liquid ejection apparatus capable of reducing a length of time extending to the completion of transfer of recording media to a reception tray while suppressing curl of the recording media to a height less than or equal to a allowable height of curl.

In one aspect of the disclosure, a liquid ejection apparatus includes: a head configured to eject liquid; a conveying mechanism configured to convey a recording medium on which an image is recorded with liquid ejected from the head; a holding mechanism configured to accommodate at least one recording medium less than or equal to a specific number, the holding mechanism comprising: a first surface which supports the recording medium conveyed by the conveying mechanism; and a second surface spaced apart from and located above the first surface in a vertical direction, the holding mechanism being configured to hold the at least one recording medium between the first surface and the second surface; a moving mechanism configured to move at least the first surface selectively to one of a support position at which the first surface supports the recording medium and a non-support position at which the first surface does not support the recording medium; a reception tray disposed under the holding mechanism, the reception tray being configured to receive a plurality of recording media having been held by the holding mechanism in a state in which the plurality of recording media are stacked on one another on the reception tray, the reception tray comprising a support surface which supports a lowermost one of the plurality of recording media; and a controller. The controller is configured to execute: a separation processing in which the controller separates the plurality of recording media, which are greater in number than the specific number and are recorded throughout one recording job, into a plurality of recording-medium groups by setting at least one separation position such that the number of recording media in each of the plurality of recording-medium groups is less than or equal to the specific number; a conveyance processing in which the controller controls the conveying mechanism to convey the recording medium to a space between the first surface and the second surface in each of the plurality of recording-medium groups; an acquisition processing in which the controller acquires a waiting time for each of the plurality of recording-medium groups obtained in the separation processing, the waiting time being a period in which each of the plurality of recording-medium groups is to wait in the holding mechanism; and a moving processing in which the controller controls the moving mechanism to move the first surface from the support position to the non-support position when a time elapsed from a timing when each of the plurality of recording-medium groups has been conveyed to the holding mechanism reaches the waiting time for said each of the plurality of recording-medium groups.

BRIEF DESCRIPTION OF THE DRAWINGS

The objects, features, advantages, and technical and industrial significance of the present disclosure will be better understood by reading the following detailed description of the embodiments, when considered in connection with the accompanying drawings, in which:

FIG. 10 is a view illustrating arrangeable temporary separating positions in a plurality of sheets;

FIG. 14A is a view illustrating one example of an individual waiting time for each sheet in a sheet group, and FIG. 14B is a view illustrating one example of a waiting time for each sheet group;

FIG. 15 is a table illustrating a relationship between a coefficient Ca and a position of a sheet from an upper side;

FIG. 16 is a table illustrating a relationship between a coefficient Cb and an ink amount;

FIG. 17 is a table illustrating a relationship between a coefficient Ca1 and a position of a sheet from an upper side; and FIG. 18 is a table illustrating a relationship between a coefficient Cb1 and an ink amount.

DETAILED DESCRIPTION OF THE EMBODIMENTS

Hereinafter, there will be described embodiments by reference to the drawings.

First, an overall construction of an ink jet printer 1 according to a first embodiment will be explained.

Figure 1:
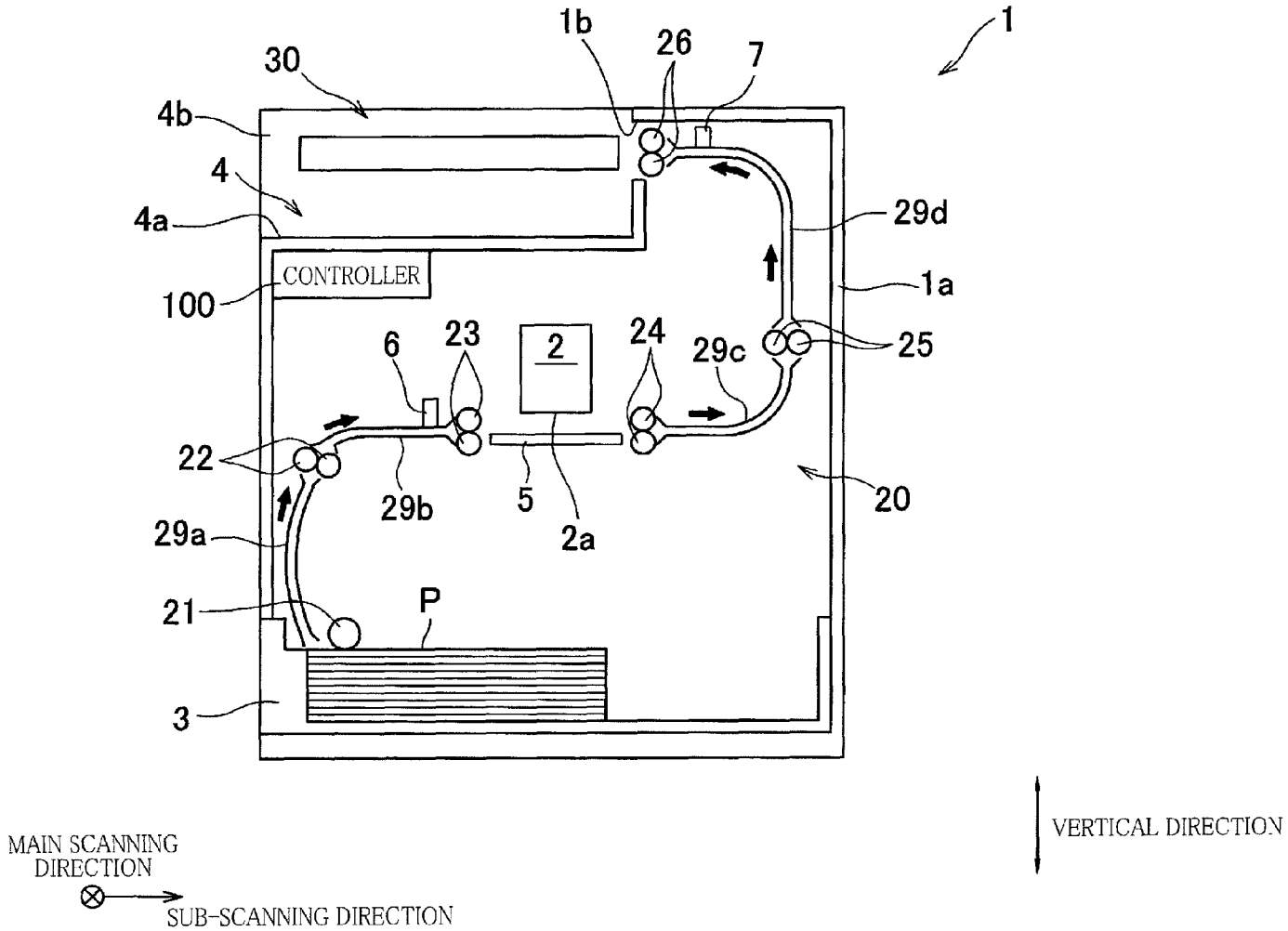
FIG. 1 is a schematic side view illustrating an internal structure of an ink jet printer according to a first embodiment.

As illustrated in FIG. 1, the printer 1 includes a housing 1*a*, an ink ejection head 2, a platen 5, a conveying unit 20 as one example of a conveying mechanism, a supply tray 3, a reception tray 4, a holding mechanism 30, a moving mechanism 40 (see FIG. 3), two sheet sensors 6, 7, and a controller 100. The head 2, the platen 5, the conveying unit 20, the supply tray 3, the two sheet sensors 6, 7, and the controller 100 are provided in the housing 1*a*. The reception tray 4 is provided on a top of the housing 1*a*. The holding mechanism 30 is disposed outside the housing 1*a* and over the reception tray 4. In other words, the reception tray 4 is disposed under the holding mechanism 30.

Figure 2:
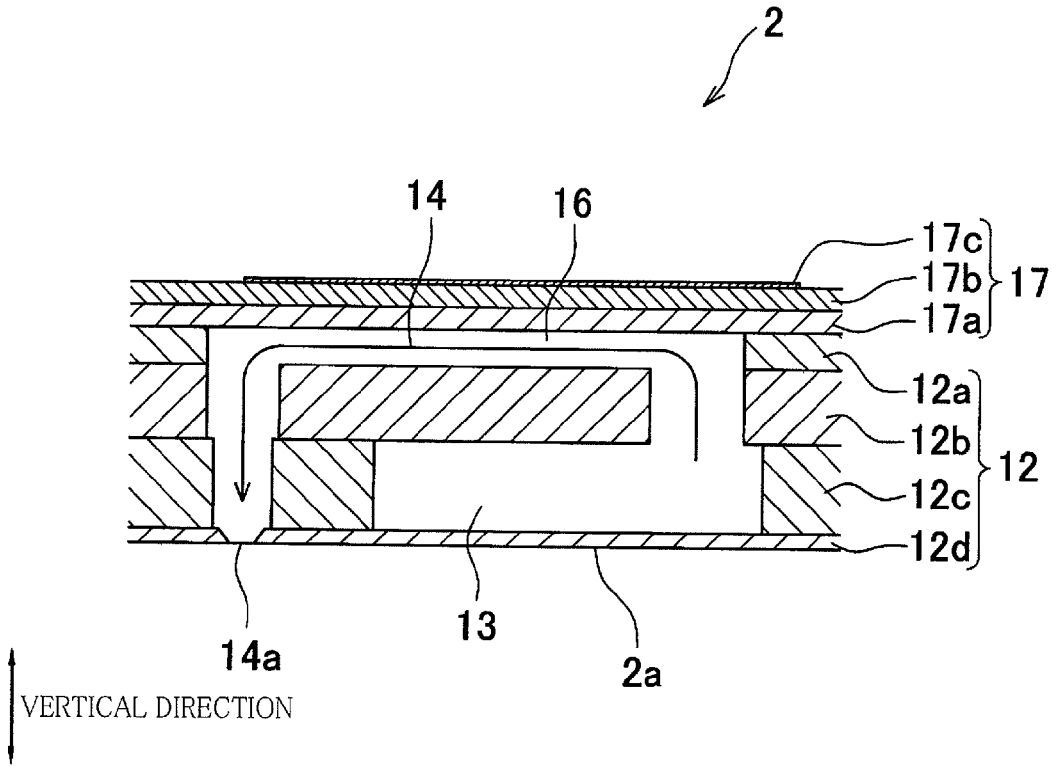
FIG. 2 is a partial cross-sectional view illustrating a head in the printer illustrated in FIG. 1.

The head 2 has a substantially rectangular parallelepiped shape elongated in a main scanning direction. As illustrated in FIG. 2, the head 2 includes a passage unit 12 and actuator units 17. It is noted that the main scanning direction is parallel with a horizontal plane. A sub-scanning direction is parallel with the horizontal plane and perpendicular to the main scanning direction. A vertical direction is perpendicular to each of the sub-scanning direction and the main scanning direction. Under the head 2, a sheet conveying direction in which a sheet P is conveyed by the conveying unit 20 is parallel with the sub-scanning direction and directed from the left toward the right in FIG. 1.

The passage unit 12 is a stacked body constituted by four plates 12*a*, 12*b*, 12*c*, 12*d* and having passages formed therein. A multiplicity of ejection openings 14*a* are opened in a lower surface of the passage unit 12. Black ink is ejected from the ejection openings 14*a* of the head 2. The passages formed in the passage unit 12 include a single manifold passage 13 and a multiplicity of individual passages 14. The individual passages 14 are defined for the respective ejection openings 14*a*. Each of the individual passages 14 extends from an outlet of the manifold passage 13 to a corresponding one of the ejection openings 14*a* via a corresponding one of pressure chambers 16. The manifold passage 13 communicates with a tank, not shown, for storing the ink. The ink supplied from the tank to the manifold passage 13 flows through the individual passages 14 and is ejected from the respective ejection openings 14*a*.

Each of the actuator units 17 is a stacked body constituted by a vibration plate 17*a*, a piezoelectric layer 17*b*, and a plurality of individual electrodes 17*c*. The vibration plate 17*a* is fixed to an upper surface of the passage unit 12 and closes the pressure chambers 16. The piezoelectric layer 17*b* is fixed to an upper surface of the vibration plate 17*a* and opposed to the pressure chambers 16. The plurality of individual electrodes 17*c* are fixed to an upper surface of the piezoelectric layer 17*b* and opposed to the respective pressure chambers 16. A portion of the actuator units 17 which is sandwiched between each of the individual electrodes 17*c* and a corresponding one of the pressure chambers 16 functions as an individual unimorph actuator for the pressure chamber 16. Each actuator is deformable independently of the other actuators in accordance with a voltage applied to the corresponding individual electrode 17*c*. When the actuator is deformed so as to protrude toward the pressure chamber 16, the volume of the pressure chamber 16 decreases, so that a pressure is applied to the ink in the pressure chamber 16, causing the ink to be ejected from the ejection opening 14*a*. By selectively applying voltages to the plurality of individual electrodes 17*c*, the head 2 can selectively eject the ink from the plurality of ejection openings 14*a*.

As illustrated in FIG. 1, the platen 5 is disposed under the head 2. A predetermined space appropriate for image recording is formed between an upper surface of the platen 5 and a lower surface of the head 2, namely, an ejection surface 2*a*.

The conveying unit 20 conveys the sheet P from the supply tray 3 to the holding mechanism 30 via the space between the head 2 and the platen 5. The conveying unit 20 includes a sheet-supply roller 21, conveying roller pairs 22-26, and guides 29*a*-29*d*.

Figure 4:
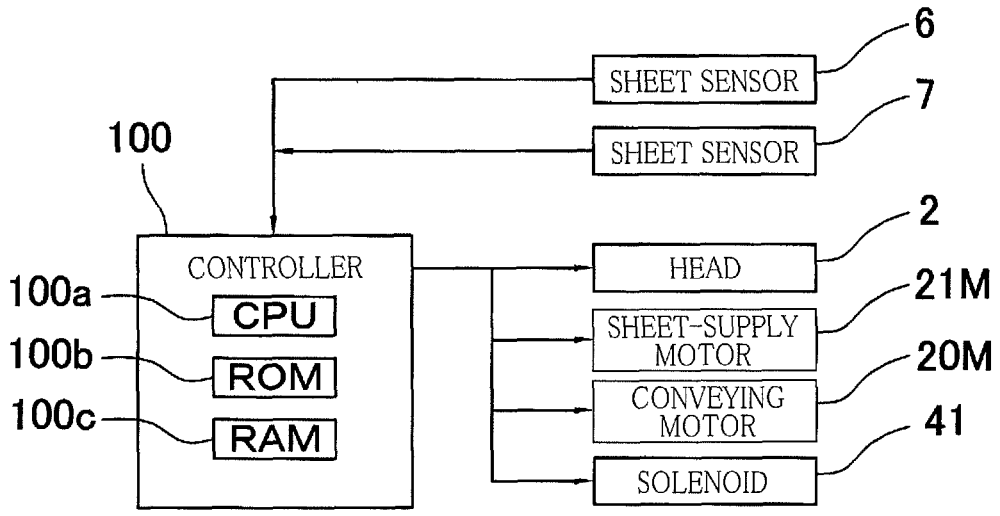
FIG. 4 is a block diagram illustrating an electric configuration of the printer illustrated in FIG. 1.
Figure 5:
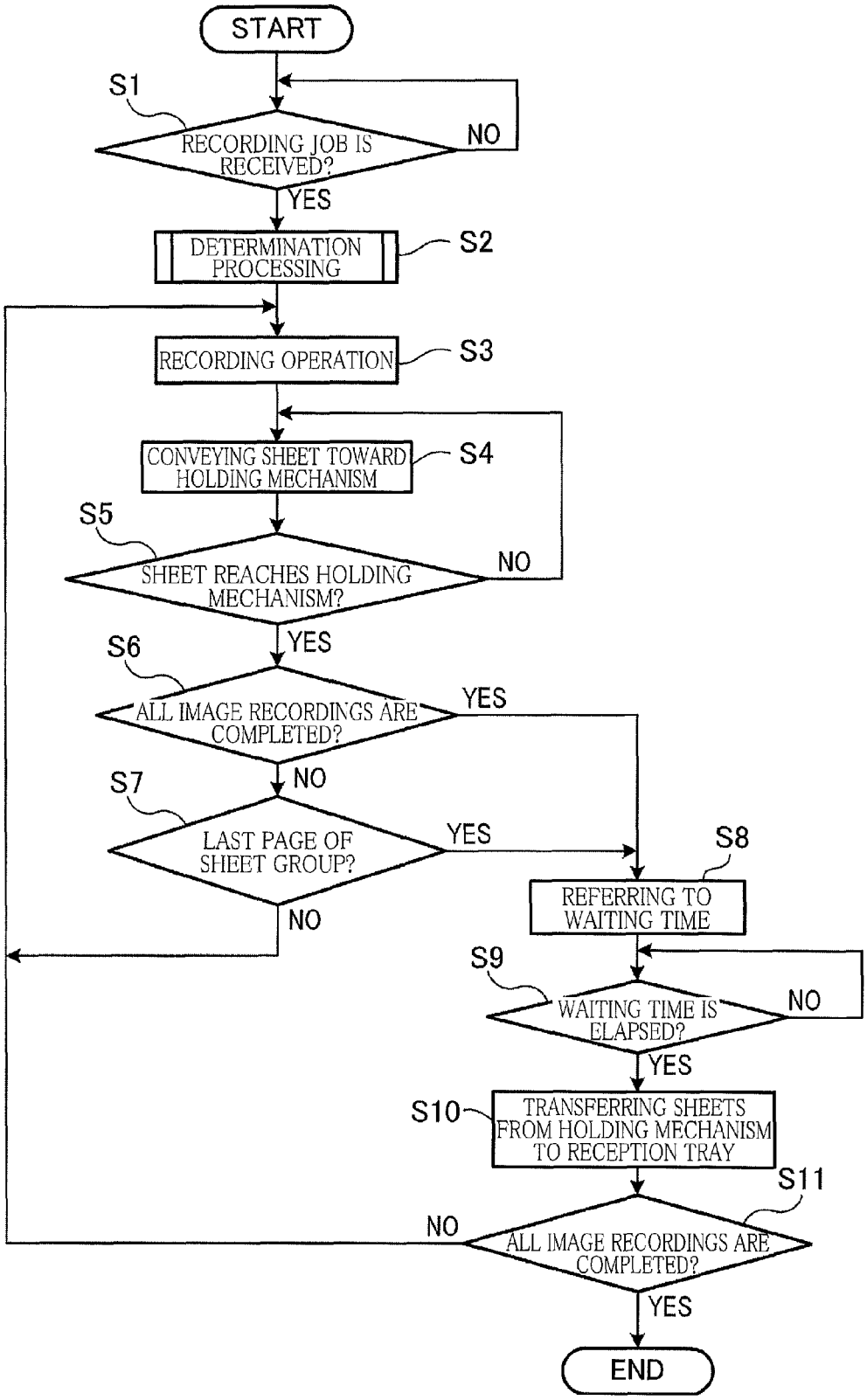
FIG. 5 is a flow chart illustrating processings executed by a controller of the printer illustrated in FIG. 1.

The sheet-supply roller 21 is disposed at a position at which the sheet-supply roller 21 is held in contact with an uppermost one of the sheets P supported on the supply tray 3. The sheet-supply roller 21 is rotated by a sheet-supply motor 21M (see FIG. 4) driven by the controller 100. This rotation supplies the uppermost sheet P from the supply tray 3. That is, the sheet-supply roller 21 conveys the sheet P from the supply tray 3 to the conveying roller pair 22.

Each of the conveying roller pairs 22-26 includes two rollers contacting each other and conveys the sheet P nipped between the two rollers. One of the two rollers of each of the conveying roller pairs 22-26 is a drive roller which is rotated by a conveying motor 20M (see FIG. 4) driven by the controller 100. The other of the two rollers of each of the conveying roller pairs 22-26 is a driven roller which is rotated, in a rotational direction reverse to that of the drive roller, by the rotation of the drive roller while being held in contact with the drive roller. The sheet P supplied from the supply tray 3 by the sheet-supply roller 21 is conveyed by the conveying roller pairs 22-26 via the space under the head 2 and discharged onto the holding mechanism 30 from an outlet 1*b* of the housing 1*a*.

Each of the guides 29*a*-29*d* includes a pair of plates spaced apart from each other so as to define a conveyance path through which the sheet P is conveyed.

The supply tray 3 is a box having an opening on its upper side and can accommodate a plurality of sheets P. In the present embodiment, a plain paper sheet of A4 size is employed as the sheet P, for example. Other examples of the sheets P include sheets of sizes other than A4 size and any types of sheets (including coated paper) as long as the sheet curls due to penetration of the ejected ink. The supply tray 3 is insertable into and removable from the housing 1*a* in the sub-scanning direction.

Figure 3A:
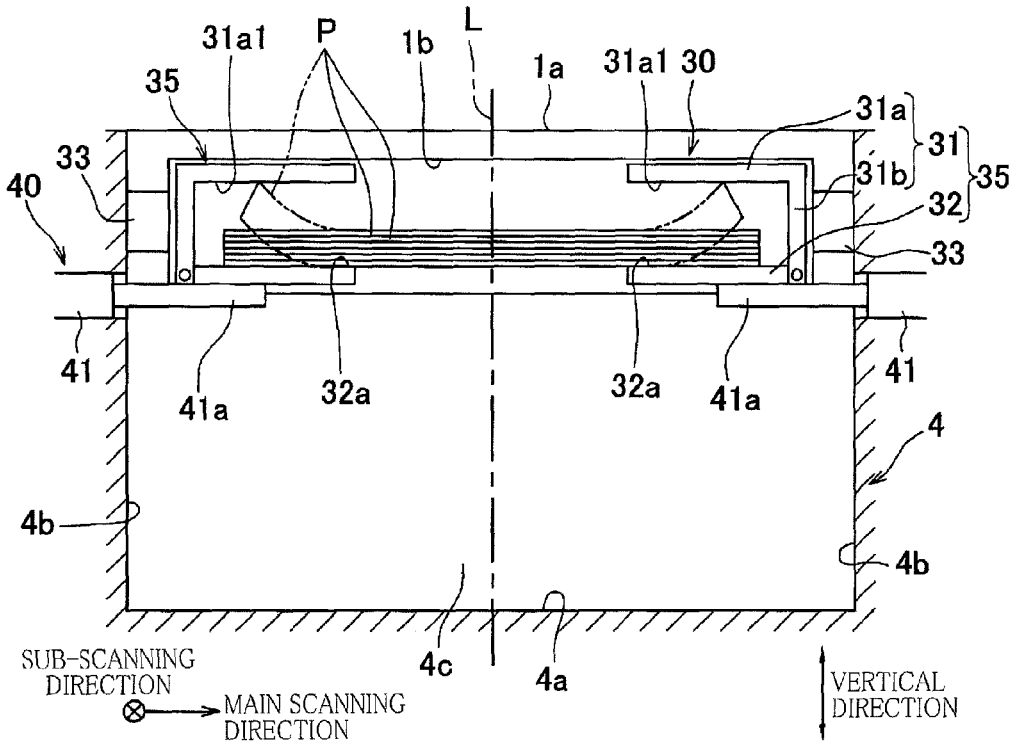
FIG. 3A is a side view illustrating a reception tray and a holding mechanism illustrated in FIG. 1 in a situation in which each of lower restraining members is located at a support position.
Figure 3B:
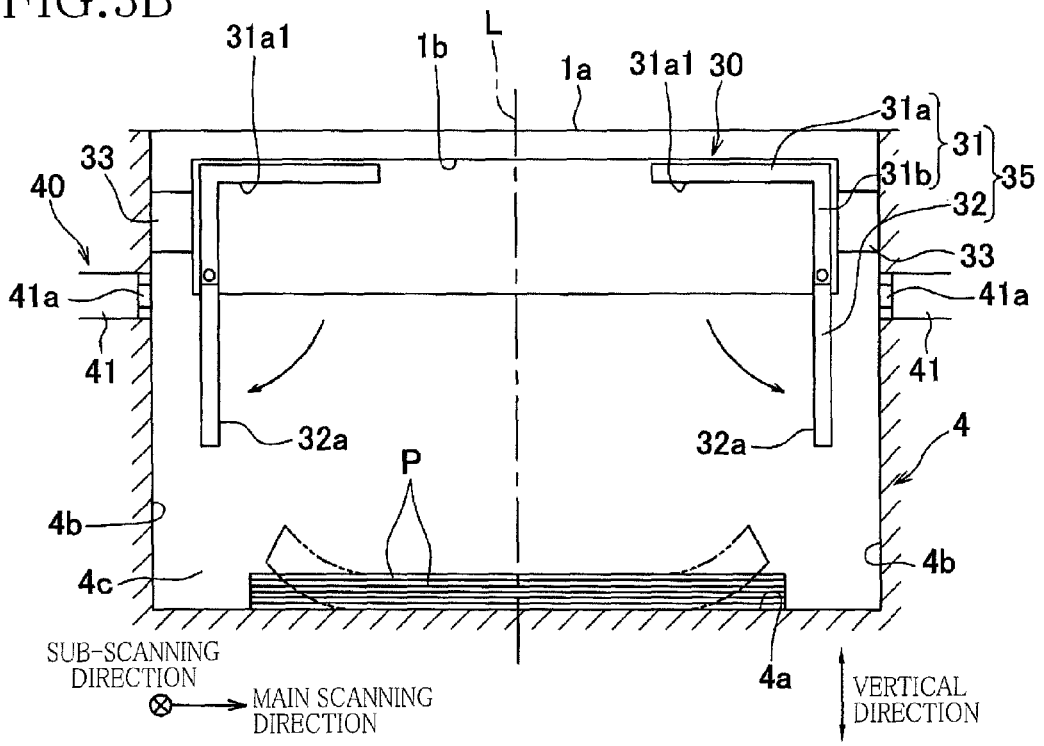
FIG. 3B is a side view illustrating the reception tray and the holding mechanism in a situation in which each of the lower restraining members is located at a non-support position.

The reception tray 4 can receive and store one or more sheets P transferred from the holding mechanism 30. As illustrated in FIGS. 3A and 3B, the reception tray 4 has a support surface 4*a*, a pair of side walls 4*b*, and a single side wall 4*c*. The support surface 4*a* supports a lower surface of the sheet P which is a recording surface of the sheet P on which an image is recorded by the head 2. The pair of side walls 4*b* stand upright on respective opposite edges of the support surface 4*a* along the sub-scanning direction. The side wall 4*c* stands upright on one edge of the support surface 4*a* along the main scanning direction (i.e., on an upstream edge of the support surface 4*a* in a conveying direction in which the sheet P is discharged from the outlet 1*b*). The outlet 1*b* is formed above the side wall 4*c*. The reception tray 4 has no downstream side wall in the conveying direction in which the sheet P is discharged from the outlet 1*b*, allowing a user to easily take the received sheets P.

There will be next explained the holding mechanism 30 and the moving mechanism 40 with reference to FIGS. 1, 3A, and 3B. As illustrated in FIG. 1, the holding mechanism 30 is disposed at a position opposed to the outlet 1*b* of the housing 1*a* in the sub-scanning direction. The holding mechanism 30 can accommodate sheets P which are less in number than the sheets P which can be accommodated in the reception tray 4. In the present embodiment, the maximum sheet capacity (as one example of a specific number) of the holding mechanism 30 is twenty, for example. The holding mechanism 30 includes a pair of restrainers 35. As illustrated in FIGS. 3A and 3B, these restrainers 35 are arranged so as to be symmetric with respect to a center line L extending in the vertical direction through a center of the support surface 4*a* in the main scanning direction.

Each of the restrainers 35 includes an upper restraining member 31 and a lower restraining member 32. As illustrated in FIGS. 3A and 3B, the upper restraining member 31 includes: a horizontal portion 31*a* having a planar plate shape; and a vertical portion 31*b* extending downward from an outer edge portion of the horizontal portion 31*a* in the main scanning direction. The upper restraining member 31 has an L-shape in cross section. A lower surface 31*a*1 (as one example of a second surface) of the horizontal portion 31*a* is longer than the sheet P in the sub-scanning direction, so that the lower surface 31*a*1 can be opposed to the entire end portion, in the sub-scanning direction, of the sheet P conveyed to the holding mechanism 30. The vertical portion 31*b* of the upper restraining member 31 is fixed to the side wall 4*b* with a fixing member 33. The lower restraining member 32 is constituted by a planar plate similar to that of the horizontal portion 31*a* and disposed between the horizontal portions 31*a* and the support surface 4*a* in the vertical direction. The lower restraining member 32 is pivotably supported by a lower edge of the vertical portion 31*b* at an outer edge portion of the lower restraining member 32 in the main scanning direction. The lower restraining member 32 is pivotable between a support position illustrated in FIG. 3A and a non-support position illustrated in FIG. 3B.

When located at the support position, the lower restraining member 32 is disposed horizontally, and an upper surface 32*a* of the lower restraining member 32 (as one example of a first surface) and the lower surface 31*a*1 of the horizontal portion 31*a* face each other in the vertical direction. When each lower restraining member 32 is located at the support position, the upper surfaces 32*a* can support the sheet P discharged from the outlet 1*b*. Specifically, the upper surfaces 32*a* support the lower surface of the sheet P discharged from the outlet 1*b*. When a plurality of sheets P are discharged onto the holding mechanism 30, the upper surfaces 32*a* support a lower surface of a lowermost one of the sheets P. The lower surfaces 31*a*1 of the respective horizontal portions 31*a* face an upper surface of an uppermost one of the sheets P.

When each lower restraining member 32 is located at the support position, each of the lower surfaces 31*a*1 of the respective horizontal portions 31*a* and a corresponding one of the upper surfaces 32*a* of the respective lower restraining members 32 are spaced apart from each other in the vertical direction so as to restrain or limit curl of one or more sheets P conveyed by the holding mechanism 30 such that the height of the curl is less than or equal to an allowable height of curl. That is, a distance between the lower surfaces 31*a*1 of the horizontal portions 31*a* and the upper surfaces 32*a* of the lower restraining members 32 in the vertical direction is less than or equal to the allowable height of curl. The allowable height of curl is a predetermined height of curl which causes no problem in discharging the next sheet P even when the sheet or sheets P are curled. It is noted that the height of curl is a distance between a lowermost point and an uppermost point of the sheet or sheets P. When the sheet P on which an image is recorded by the ejected ink is conveyed onto the holding mechanism 30, the image-recorded surface is extended during penetration of the ink in the sheet P, whereby edges of the sheet P move upward or curl. The two-dot chain lines in FIG. 3A illustrate the case where a plurality of sheets P are curled. Even if the sheets P are to curl in a great degree, since the lower surfaces 31*a*1 of the horizontal portions 31*a* are arranged over the sheets P (that is, the lower surfaces 31*a*1 and the upper surfaces 32*a* are arranged spaced apart from each other so as to limit the height of the curl to less than or equal to the allowable height), the height of the curl of the sheets P is less than or equal to the allowable height.

When located at the non-support position, each lower restraining member 32 extends in the vertical direction, and the upper surface 32*a* of the lower restraining member 32 and the lower surface 31*a*1 of the horizontal portion 31*a* do not face each other in the vertical direction. When each lower restraining member 32 is located at the non-support position, the upper surfaces 32*a* cannot support a lower surface of the sheet P. That is, when the lower restraining members 32 are moved to the non-support position by the moving mechanism 40, the sheets P supported by the holding mechanism 30 are moved or transferred to the reception tray 4. Also, when the lower restraining members 32 are located at the non-support position, the restraint of the curl of the sheets P is canceled.

The moving mechanism 40 includes a pair of solenoids 41. The solenoids 41 are fixed to the respective side walls 4*b* to move respective movable iron cores 41*a*. Specifically, each of the solenoids 41 moves a corresponding one of the movable iron cores 41*a* in the main scanning direction such that the movable iron core 41*a* can protrude from and retract into the side wall 4*b*. Each solenoid 41 is disposed such that the movable iron core 41*a* is lower in height than the upper restraining member 31 and near a lower end of the vertical portion 31*b* in the vertical direction. That is, the solenoid 41 is disposed such that the movable iron core 41*a* is opposed to the lower restraining member 32 located at the non-support position. When the pair of solenoids 41 are driven by the controller 100 so as to move each of the movable iron cores 41*a* to a protruding position (indicated in FIG. 3A) at which the movable iron core 41*a* protrudes from a corresponding one of the side walls 4*b*, the movable iron core 41*a* and a corresponding one of the lower restraining members 32 are engaged with each other to move and position the lower restraining member 32 to the support position. On the other hand, when the pair of solenoids 41 are driven by the controller 100 so as to move each of the movable iron cores 41*a* from the protruding position to a retracted position (indicated in FIG. 3B) at which the movable iron core 41*a* is retracted into the corresponding side wall 4*b*, the movable iron core 41*a* and the corresponding lower restraining member 32 are disengaged from each other to move and position the lower restraining member 32 to the non-support position. As described above, by moving the lower restraining members 32 from the support position to the non-support position, the moving mechanism 40 can transfer the sheets P from the holding mechanism 30 to the reception tray 4. Also, by positioning each lower restraining member 32 to the support position, the moving mechanism 40 allows the holding mechanism 30 to support the sheets P.

The controller 100 includes a central processing unit (CPU) 100*a* as a computing device, a read only memory (ROM) 100*b*, a random access memory (RAM) 100*c* (which may be a non-transitory RAM), an application specific integrated circuit (ASIC), and an interface (I/F), and an input/output (I/O) port. The ROM 100*b* stores programs to be executed by the CPU 100*a* and various kinds of fixed data including data relating to coefficients Ca, Cb, Cc which will be described below, for example. The RAM 100*c* temporarily stores data required for execution of the programs. The ASIC executes rewriting and sorting of image data and other processings such as a signal processing and an image processing. The interface transmits and receives data to and from an external device such as a PC connected to the printer 1. The input/output port inputs and outputs signals produced by various sensors.

There will be next explained processings executed by the controller 100 with reference to flow charts in FIGS. 5-8. The controller 100 repeats the routine illustrated in FIG. 5 while a power source of the printer 1 is ON. In the present embodiment, there will be explained the case where images are respectively recorded on a plurality of sheets P based on a recording job, i.e., data indicating a series of processings which corresponds to a recording command for image recording on at least one sheet P.

This flow begins with S1 at which the controller 100 determines whether or not the controller 100 has received the recording job containing the image data which is transmitted from the external device. When the recording job is not received (S1: NO), this flow repeats the processing at S1. When the recording job is received (S1: YES), the controller 100 at S2 executes a determination processing. In the present embodiment, it is assumed that the controller 100 receives the recording job indicating that the number of sheets P to be recorded is thirty (that is, the number of sheets to be recorded is greater than the maximum sheet capacity of the holding mechanism 30).

Figure 6:
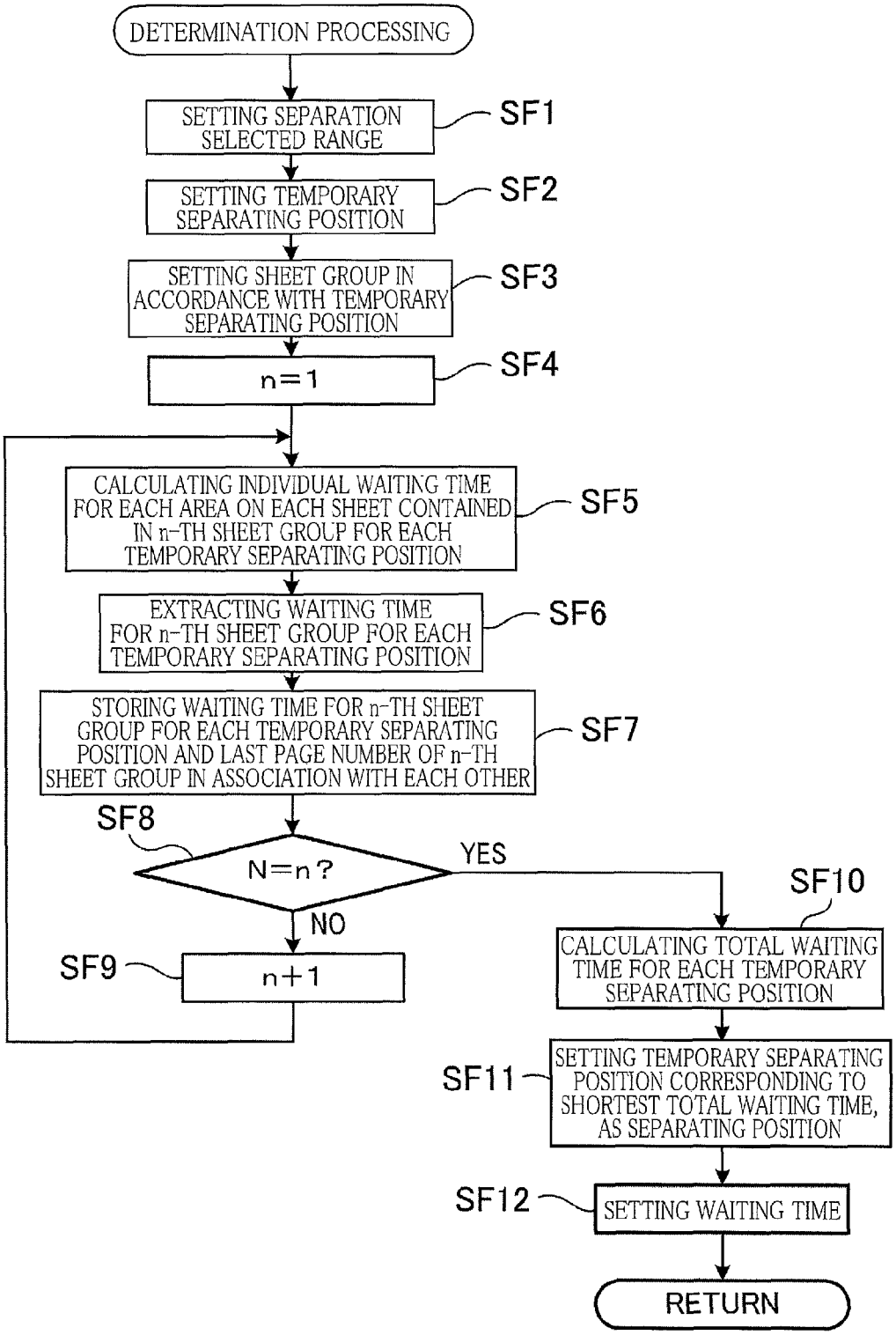
FIG. 6 is a flow chart illustrating a processing at S2 in FIG. 5.

In the processing at S2 as illustrated in the flow in FIG. 6, the controller 100 at SF1 determines and sets a separation selected range of the number of sheets P to be recorded based on the current recording job. The controller 100 at SF1 sets the separation selected range on condition that the sheets P (the number of sheets P) to be recorded are separated with the minimum number of separations. The minimum number of separations is determined by the maximum sheet capacity of the holding mechanism 30 and the number of sheets P to be recorded based on the recording job. The minimum number of separations is the minimum number of separating positions (as one example of a particular number). In this case, since the number of sheets P to be recorded is thirty, and the maximum sheet capacity of the holding mechanism 30 is twenty, the number of separating positions is one, and temporary separating positions are respectively set between tenth to twenty-first sheets P of the sheets P to be recorded. In other words, each of the temporary separating positions is set between corresponding successive two of the tenth to twenty-first sheets P. Each of sheet groups defined by the temporary separating positions contains at least one sheet which is less than or equal to the maximum sheet capacity. The controller 100 sets, with respect to the separating position, the separation selected range which is the range of the sheets P from the tenth sheet to the twentieth sheet and which contains the temporary separating positions forming the sheet groups, in each of which the number of sheets P is less than or equal to the maximum sheet capacity.

After SF1, the controller 100 at SF2 sets the temporary separating positions in the separation selected range set at SF1. That is, the controller 100 sets the temporary separating positions in the following manner: the controller 100 sets a position between the tenth sheet and eleventh sheet as a first temporary separating position, a position between the eleventh sheet and twelfth sheet as a second temporary separating position, . . . , and a position between a twentieth sheet and a twenty-first sheet as an eleventh temporary separating position, in order.

After SF2, the controller 100 at SF3 sets the number of sheet groups and the sheets P contained in each sheet group in accordance with the set temporary separating positions. In the present embodiment, since the number of sheets P to be recorded is thirty, the number of sheet groups is two at any of the temporary separating positions. Specifically, a first half of the sheet groups obtained by separating the sheets P at the temporary separating position is a first sheet group, and a second half of the sheet groups is a second sheet group. That is, in the case where the first temporary separating position is used, the first sheet group is constituted by the first to tenth sheets P, and the second sheet group is constituted by eleventh to thirtieth sheets P. In the case where the second temporary separating position is used, the first sheet group is constituted by the first to eleventh sheets P, and the second sheet group is constituted by twelfth to thirtieth sheets P. The sheets P contained in the sheet groups are set for each of the temporary separating positions. After SF3, the controller 100 sets n to 1 at SF4. The variable n indicates the ordinal number of the sheet group.

After SF4, the controller 100 at SF5 calculates an individual waiting time for each of areas A1-F5 on each of the sheets P contained in an n-th sheet group for each of the temporary separating positions. That is, the controller 100 at SF5 calculates the individual waiting time by multiplying a reference waiting time by the three coefficients Ca, Cb, Cc for each of the areas A1-F5 on each sheet P. The reference waiting time is set at ten seconds in the present embodiment. The calculated individual waiting time is a waiting time required for reducing an amount of curl at each of the areas A1-F5.

Figure 7:
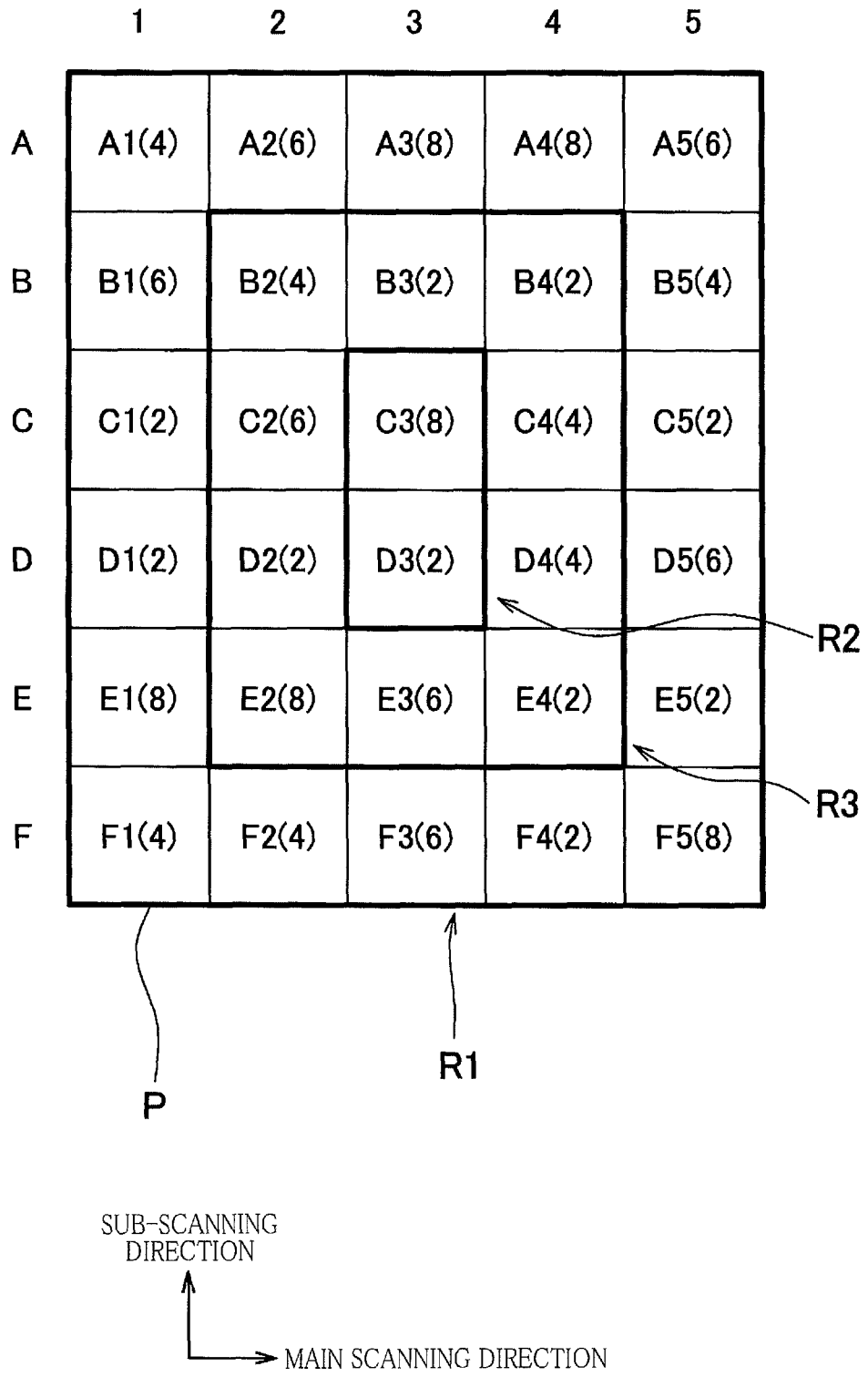
FIG. 7 is a view for explaining areas defined on a sheet.

As illustrated in FIG. 7, the areas A1-F5 are arranged in the main scanning direction coinciding with a widthwise direction of the sheet P and in the sub-scanning direction coinciding with the sheet conveying direction. More specifically, the areas A1-F5 are obtained by dividing the entire length of the sheet P in the main scanning direction into equal five portions and dividing the entire length of the sheet P in the sub-scanning direction into equal six portions. The characters A-F are respectively assigned to the five portions, and the numbers 1-5 are respectively assigned to the six portions in order to identify the areas A1-F5. These areas A1-F5 are divided into an outer region R1, an inner region R2, and an intermediate region R3. The outer region R1 is constituted by the areas A1, A2, A3, A4, A5, B1, B5, C1, C5, D1, D5, E1, E5, F1, F2, F3, F4, and F5. The outer region R1 is the outermost peripheral region on the sheet P. The inner region R2 is constituted by the areas C3, D3 and located at a central portion on the sheet P. The intermediate region R3 is constituted by the areas B2, B3, B4, C2, C4, D2, D4, E2, E3, and E4 and located between the outer region R1 and the inner region R2 so as to enclose the inner region R2.

The coefficient Ca, illustrated in FIG. 15, relates to a relative position of the sheet P in the vertical direction in the sheet group when the sheets P contained in the sheet group are transferred to the reception tray 4 after being kept waiting on the holding mechanism 30. As illustrated in FIG. 15, the coefficient Ca increases with increase in the height position of the sheet on the reception tray 4. It is noted that the conveyed sheets P are superposed on the holding mechanism 30 successively from the lower side to the upper side. The sheets P superposed on the holding mechanism 30 are transferred to the reception tray 4 without changing this state. In the present embodiment, accordingly, the positional relationship of the sheet P in the holding mechanism 30 is the same as that on the reception tray 4. The coefficient Ca relating to a relative position of the sheet P in the vertical direction among the sheets P in the sheet group at least needs to be a coefficient relating to a relative position of the sheet P in the sheet group on any of the holding mechanism 30 and the reception tray 4.

In the present embodiment, the coefficient Ca for the uppermost one of the sheets P supported on the reception tray 4 is set at one, and the coefficient Ca for the sheet P located under the uppermost sheet decreases with increase in distance from the uppermost sheet P. No sheet is placed on the uppermost one of the sheets P supported on the reception tray 4. That is, the uppermost one of the sheets P needs to wait in the holding mechanism 30 to prevent the sheet P from further curling due to the ejected ink to a height greater than the allowable height of curl.

At least one sheet P is placed on the upper side of each of the sheets P other than the uppermost sheet P (hereinafter, each sheet placed over another sheet may be referred to as "upper sheet", and each sheet placed under another sheet may be referred to as "lower sheet"). Thus, even if the lower sheet P on the reception tray 4 is to further curl, the weight of the upper sheet or sheets P suppresses the development of the curl. More specifically, in the case of the sheets P for which the same amount of the ink is to be ejected onto the same areas, the development of the curl of the lower sheet P is less than that of the upper sheet P by the weight effect of the weight of the upper sheet P. That is, the height of curl is lowered. Thus, the lower sheet P requires a shorter length of time for recovery to a state before the occurrence of the curl, than the upper sheet. In other words, a length of time from a start of the development of the curl to an end of the development after the height of the curl exceeds the allowable height of curl is shorter in the lower sheet P than in the upper sheet. Such suppression of the development of the curl, i.e., reduction in a recovery time is caused in any of the holding mechanism 30 and the reception tray 4. Thus, the coefficient Ca for each sheet P located under the uppermost sheet P is set with consideration of such suppression. That is, in the holding mechanism 30, the lower sheet P requires a shorter length of time for recovery to a state before the occurrence of the curl, than the upper sheet by the weight effect of the own weight of the upper sheet. That is, the lower sheet P requires a shorter waiting time than the upper sheet. Accordingly, consideration of the relative positions of the plurality of sheets P in the holding mechanism 30 allows effective reduction in the waiting time for the sheets P. In the reception tray 4, even if the lower sheet P is to curl, the curl is restrained by the weight effect of the weight of the upper sheet. That is, the lower sheet P requires a shorter waiting time than the upper sheet. Accordingly, consideration of the relative positions of the plurality of sheets P in the reception tray 4 allows further effective reduction in the waiting time for the sheets P. The degree of suppression of the development of the curl increases with increase in the number of sheets P. In the case of more than or equal to a certain number of sheets (five sheets in the present embodiment), it is possible to reliably prevent such development of the curl to a height exceeding the allowable height on the reception tray 4. Accordingly, the coefficient Ca for the fifth or subsequent sheet P from the uppermost sheet P on the reception tray 4 is set at zero.

In the present embodiment, the coefficient Ca is set such that even if each sheet P transferred from the holding mechanism 30 to the reception tray 4 has curled, the curl is not developed at least to a degree in which the height of the curl exceeds the allowable height of curl.

The coefficient Cb, illustrated in FIG. 16, relates to an amount of ink to be ejected onto each of the areas A1-F5 on each sheet P. As illustrated in FIG. 16, the coefficient Cb increases with increase in the amount of ink to be ejected onto each of the areas A1-F5. In each of the areas A1-F5, increase in the amount of ink to be ejected increases a time required for the ink to penetrate the sheet, which increases a length of time of development of the curl. In other words, in each of the areas A1-F5, decrease in the amount of ink to be ejected decreases the time required for the ink to penetrate the sheet, which reduces the time of development of the curl. In the present embodiment, it is assumed that the maximum amount of ink to be ejected onto each of the areas A1-F5 (i.e., a state in which ink is ejected on the entire area) is 100%, and the coefficient Cb in this state is one. The coefficient Cb decreases with decrease in the amount of ink to be ejected, to 80%, 60%, 40%, 20%, and 0%. It is noted that when the ink amount is 0%, the sheet is not curled at the area, and accordingly the coefficient Cb is zero.

The coefficient Cc relates to ease of generation or development of curl for each of the areas A1-F5 on each sheet P. In the present embodiment, the coefficient Cc for each area in the outer region R1 is set at 1, the coefficient Cc for each area in the inner region R2 is set at 0.2, and the coefficient Cc for each area in the intermediate region R3 is set at 0.5. The coefficient Cc increases from the center (i.e., an inner region) of the sheet P to edges (i.e., an outer region) of the sheet P. This is because the degree of curl of the sheet P is larger in the case where the same amount of ink is ejected to the outer region than to the inner region. In the case where the same amount of ink is ejected, the sheet is curled for the same length of time by the ink, but the sheet is curled in the larger degree on the region nearer to the edges of the sheet P. As thus described, the coefficient Cc is large on the outer region R1 of the sheet P which greatly affects the degree of curl.

At SF5, the controller 100 first calculates the individual waiting time for each of the areas A1-F5 on the uppermost one of the sheets P supported on the reception tray 4, for each of the temporary separating positions. For example, in the case where the ink amount on the area A1 for the first temporary separating position is 40%, four seconds are obtained as the individual waiting time for the area A1 by multiplication of 10 seconds as the reference waiting time, 1 as the coefficient Ca, 0.4 as the coefficient Cb, and 1 as the coefficient Cc (10×1×0.4×1). It is noted that the amount of ink to be ejected onto each of the areas A1-F5 is calculated by the controller 100 referring to the image data contained in the recording job. The controller 100 calculates the individual waiting time for each of the areas A2-F5 in the same manner as that for the area A1. Examples of the individual waiting times (sec.) calculated in this manner are indicated in FIG. 7 with parentheses for the areas A1-F5. After the individual waiting times are calculated for all the areas A1-F5 on the uppermost one of the sheets P, the controller 100 similarly calculates the individual waiting time for each of the areas A1-F5 on each of the other sheets P contained in the n-th sheet group for the first temporary separating position. In this calculation, the controller 100 calculates the individual waiting time for each of the areas A1-F5 on all the sheets P contained in the n-th sheet group for the temporary separating positions other than the first temporary separating position. All the calculated individual waiting times for the temporary separating positions are stored into the RAM 100*c*. In the calculation of the individual waiting time for each of all the areas A1-F5 on the sheets P contained in the n-th sheet group, the calculation may be performed for any of the areas A1-F5 on any of the sheets P first.

Figures 8A, 8B, 9:
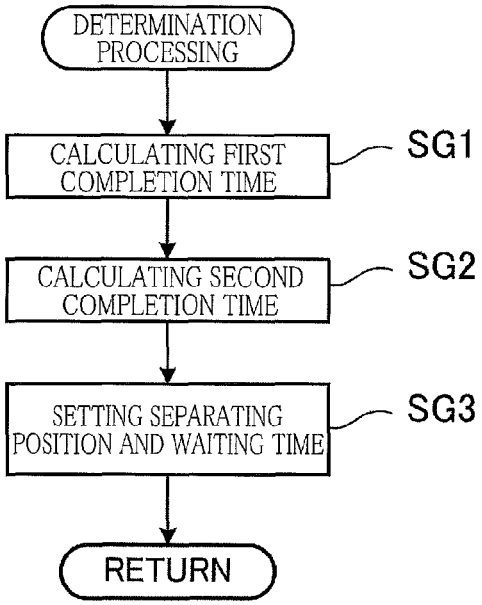
FIG. 8A is a view illustrating one example of an individual waiting time for each sheet for a first temporary separating position.
FIG. 8B is a view illustrating one example of a waiting time for each sheet group for each temporary separating position and one example of a total waiting time for each temporary separating position.
FIG. 9 is a flow chart illustrating a determination processing executed by the controller of the printer according to a second embodiment.

The controller 100 at SF6 extracts the waiting time for the n-th sheet group for each of the temporary separating positions. Specifically, the controller 100 first extracts the individual waiting time for each of the sheets P contained in the n-th sheet group for each of the temporary separating positions. That is, the controller 100 extracts the longest individual waiting time among the areas A1-F5 of the sheets P and determines the longest individual waiting time as the individual waiting time for each of the sheets P for each of the temporary separating positions. For example, as illustrated in FIG. 7, eight seconds are the longest value on the uppermost one of the sheets P supported on the reception tray 4 for the first temporary separating position and are determined as the individual waiting time for the sheet P. The controller 100 extracts the individual waiting time for the other sheets P in the same manner. FIG. 8A illustrates examples of the individual waiting times for each of the sheets P contained in the first sheet group for the first temporary separating position. It is noted that since the coefficient Ca is zero for the five and subsequent sheets P from the uppermost sheet P, all the individual waiting times therefore are zero. The controller 100 then extracts the longest individual waiting time among the sheets P and determines the longest individual waiting time as the waiting time for the n-th sheet group for the first temporary separating position. That is, the longest individual waiting time (i.e., eight seconds) among the individual waiting times in FIG. 8A is determined as the waiting time for the n-th sheet group (i.e., the first sheet group) for the first temporary separating position. The controller 100 similarly extracts the waiting times for the n-th sheet group for the temporary separating positions other than the first temporary separating position. Since the waiting time for the n-th sheet group is determined as the longest individual waiting time among the individual waiting times for each of the sheets P, it is possible to reliably suppress curl of the sheets P contained in the n-th sheet group. As a modification, the controller 100 may extract the longest individual waiting time among the individual waiting times for the areas A1-F5 on all the sheets P contained in the n-th sheet group for each of the temporary separating positions and determine the extracted longest individual waiting time as the waiting time for the n-th sheet group for each of the temporary separating positions. This configuration can eliminate the need for extracting the individual waiting times for each of the sheets P in the n-th sheet group for each of the temporary separating positions.

The controller 100 at SF7 stores, into the RAM 100*c*, the waiting time, extracted at SF6, for the n-th sheet group for each of the temporary separating positions and the last page number of the n-th sheet group in association with each other. As a result, the waiting time for the n-th sheet group is set for each of the temporary separating positions. FIG. 8B illustrates examples of the waiting times for the sheet group (the first sheet group at this time) for each of the temporary separating positions.

After SF7, the controller 100 at SF8 determines whether the variable n of the n-th sheet group for each of the temporary separating positions is equal to the set number of sheet groups N or not. When the number N set at SF3 is not equal to n (SF8: NO), the controller 100 has not finished setting the waiting times for all the sheet groups for each of the temporary separating positions. Thus, this flow goes to SF9 at which the controller 100 increments n by one, and this flow returns to SF5. That is, the controller 100 repeats the processings at SF5-SF7 by the number of sheet groups. FIG. 8B also illustrates examples of the waiting times for the sheet group (the second sheet group at this time) for each of the temporary separating positions. On the other hand, when N is equal to n (SF8: YES), the waiting times for the respective sheet groups for each of the temporary separating positions have been set, and this flow goes to SF10.

The controller 100 at SF10 calculates a total waiting time which is the sum of the waiting time (the longest individual waiting time) for the first sheet group and the waiting time (the longest individual waiting time) for the second sheet group for each of the temporary separating positions. That is, as illustrated in FIG. 8B, for example, the total waiting time for the first temporary separating position is thirteen seconds, the total waiting time for the second temporary separating position is nine seconds, and the total waiting time for the eleventh temporary separating position is thirteen seconds. It is noted that the total waiting times for the third to tenth temporary separating positions are omitted.

After SF10, the controller 100 at SF11 extracts the shortest total waiting time among all the total waiting times calculated at SF10 and sets the temporary separating position corresponding to the shortest total waiting time, as the separating position. That is, the controller 100 sets the second temporary separating position corresponding to the shortest total waiting time, as the separating position for the current recording job.

In accordance with the setting of the separating position at SF11, the controller 100 at SF12 sets the waiting time stored at SF7 for each sheet group for the second temporary separating position, as the waiting time for each sheet group in the current recording job. Here, a completion time refers to a length of time extending from conveyance of the first sheet P from the supply tray 3 for image recording based on the recording job, to the completion of transfer of the last sheet P onto the reception tray 4 based on the recording job. In the case where the number of separating positions (the number of separations) is smallest, the completion time decreases with decrease in the sum of the waiting times for the respective two sheet groups relating to the separating position. Thus, the completion time is reduced by setting the second temporary separating position corresponding to the shortest total waiting time, as the separating position. Upon the completion of the processing at SF12, the determination processing ends, and the flow goes to S3.

The controller 100 at S3 controls the head 2 and other devices to perform a recording operation on a sheet P based on the recording job. That is, the controller 100 controls the sheet-supply motor 21M and the conveying motor 20M to convey the uppermost one of the sheets P supported on the supply tray 3 and controls the head 2 based on image data and signals output from the sheet sensor 6 to eject a specific amount of ink onto each of the areas A1-F5 on the sheet P. As a result, an image is recorded on the sheet P. The controller 100 at S4 controls the conveying motor 20M to convey the image-recorded sheet P to the holding mechanism 30 (i.e., the space between the upper surfaces 32*a* of the respective lower restraining members 32 and the lower surfaces 31*a*1 of the horizontal portions 31*a* of the respective upper restraining members 31).

The controller 100 at S5 determines, based on a signal output from the sheet sensor 7, whether the image-recorded sheet P reaches the holding mechanism 30 or not. When the sheet P does not reach the holding mechanism 30 (S5: NO), this flow returns to S4. When the sheet P reaches the holding mechanism 30, this flow goes to S6.

The controller 100 at S6 determines whether the recording operation has been performed for all the sheets P in the sheet group based on the recording job or not. When the recording operation has not been performed for all the sheets P (S6: NO), this flow goes to S7. When the recording operation has been performed for all the sheets P (S6: YES), this flow goes to S8. The controller 100 at S7 determines whether the page of the most-recently recorded sheet P is the last page of the sheet group or not. When the page is not the last page, this flow returns to S3. When the page is the last page, this flow goes to S8. By repetition of the processings at S3-S7, a plurality of sheets P are conveyed to the holding mechanism 30 for each sheet group based on the separating position set at SF11. This processing is one example of a conveyance processing.

The controller 100 at S8 refers to one of the waiting times set at SF12, as a current waiting time for the sheet group, which one waiting time is for the number of the last page corresponding to the most-recently recorded sheet P. After S8, the controller 100 at S9 determines whether or not the current waiting time is elapsed from the timing when the sheet P of the last page of the sheet group is conveyed to the holding mechanism 30. When the current waiting time is not elapsed (S9: NO), the controller 100 repeats the processing at S9. When the current waiting time is elapsed (S9: YES), the controller 100 at S10 controls the moving mechanism 40 to transfer the plurality of sheets P held in the holding mechanism 30, to the reception tray 4. This processing is one example of a moving processing. At S10, the controller 100 controls the solenoids 41 to move the lower restraining members 32 from the support position to the non-support position, so that the plurality of sheets P supported on the holding mechanism 30 are transferred to the reception tray 4. Even if the sheets P held in the holding mechanism 30 are curled as indicated by the two-dot chain lines in FIG. 3B, the height of the curl is less than or equal to the allowable height of curl because the sheets P are supported between the lower surfaces 31*a*1 of the respective horizontal portions 31*a* and the upper surfaces 32*a* of the respective lower restraining members 32. Furthermore, the holding mechanism 30 prevents the curl from developing to the degree in which the height of the curl is higher than the allowable height of curl. As indicated by the solid lines in FIG. 3B, the degree of the curl of the sheets P decreases with a lapse of time, and the sheets P are returned to a state before generation of the curl.

After S10, the controller 100 at S11 determines whether the recording operation has been performed for all the sheets P based on the recording job or not. When the recording operation has not been performed for all the sheets P (S11: NO), this flow goes to S3 at which the controller 100 starts the recording operation for the sheets P contained in the next sheet group. When the recording operation has been performed for all the sheets P (S11: YES), this flow ends.

In the printer 1 according to the present embodiment described above, even in the case where the number of sheets P to be recorded based on the recording job is larger than the maximum sheet capacity of the holding mechanism 30, the controller 100 divides the sheets P into a plurality of sheets group each containing at least one sheet P less in number than the maximum sheet capacity, and the sheets P are conveyed to the holding mechanism 30 in the sheet groups. Accordingly, when the plurality of sheets P contained in the sheet group are at rest in the holding mechanism 30, the height of curl of the sheets P can be less than or equal to the allowable height. In the present embodiment, the separating position for the sheets P is a position at which the sheets P can be separated with the minimum number of separations and which is one of the temporary separating positions at which the sum of the waiting times for the respective sheet groups is the shortest. The completion time relating to the recording job includes: the waiting time for which the sheets P in each sheet group are at rest in the holding mechanism 30; and the other times which are elapsed on the same condition for any of the separating positions. The other times include: a length of time in which all the sheets P are conveyed from the supply tray 3 to the holding mechanism 30 with image recording based on the recording job; and a length of time in which at least one sheet P is transferred from the holding mechanism 30 to the reception tray 4 for each of the sheet groups. Thus, in the case where the sum of the waiting times for the respective sheet groups is shortest, the completion time based on the recording job becomes shortest. Accordingly, it is possible to reduce the completion time while keeping the height of curl of the sheets P less than or equal to the allowable height of curl.

In the processings at SF5-SF11, the temporary separating position corresponding to the shortest one of the total waiting times is set as the separating position. This processing facilitates determination of the separating position.

At SF12, the waiting time for each sheet group for the temporary separating position set as the separating position is set as the waiting time for each sheet group in the current recording job. Thus, each of the individual waiting time is calculated based on the amount of ink to be ejected onto the areas A1-F5 and the relative position of the sheet P on the reception tray 4, for example. The calculation of the individual waiting time based on the relative position of the sheet P means that it is considered that development of the curl is suppressed due to the weight of the upper sheet P in both of the holding mechanism 30 and the reception tray 4. That is, at the timing when the height of the curl does not further increase to a height higher than the allowable height, the sheet group can be transferred from the holding mechanism 30 to the reception tray 4. Since the recovery time for recovering or eliminating the curl can be reduced in the holding mechanism 30, the sheet group can be transferred to the reception tray 4 at an earlier timing. Accordingly, the individual waiting time can be effectively reduced. The controller 100 extracts the longest one of the individual waiting times for each sheet group and calculates the sum of the longest individual waiting times as the total waiting time. The controller 100 determines, as the waiting time, each of the longest individual waiting times for respective sheet groups corresponding to the shortest one of the total waiting times calculated for the respective temporary separating positions. This processing can effectively reduce the waiting time in the holding mechanism 30.

At SF5, the controller 100 calculates the individual waiting time for each of areas A1-F5 on each of the sheets P by multiplication of the reference waiting time and the three coefficients Ca, Cb, Cc. In this calculation, the individual waiting time can be easily obtained by the multiplication of the predetermined reference waiting time and the coefficients Ca, Cb, Cc. Since the individual waiting time is thus calculated by the multiplication using the coefficient Cc, the individual waiting time can be calculated accurately. The coefficient Cb increases with increase in the amount of ink to be ejected onto the areas A1-F5, the coefficient Ca increases with the shorter distance to the uppermost sheet P, and the coefficient Cc increases with the shorter distance to any of the edges of the sheet P. Accordingly, the individual waiting time can be calculated accurately.

As a modification, the individual waiting time for each of the areas A1-F5 on each sheet P may be calculated by multiplication of the reference waiting time and the two coefficients Ca, Cb. The controller 100 extracts one of the individual waiting times obtained in this manner, as the waiting time, after the processing at SF6. The temporary separating position corresponding to the individual waiting time extracted as the waiting time is set as the separating position. This modification can obtain the same effects as obtained in the above-described embodiment. As another modification, only one area may be defined on each of the sheets P without defining a plurality of areas. In this modification, one surface of the sheet P is defined as the one area, and the individual waiting time for each sheet P may be calculated by multiplication of the reference waiting time and the two coefficients Ca, Cb. The coefficient Cb in this case is a coefficient relating to the entire sheet P, i.e., an amount of ink to be ejected onto the one area.

There will be next explained a printer according to a second embodiment with reference to FIG. 9. In the printer 1 according to the first embodiment, the sheets P are separated in the determination processing such that the number of separating positions becomes the minimum number. In the printer according to the present embodiment, in contrast, the controller 100 compares (i) a first completion time required in the case where the number of sheets P to be recorded is separated such that the number of separating positions becomes the minimum number (as another example of the particular number) and (ii) a second completion time required in the case where the number of sheets P to be recorded is separated such that the number of separating positions becomes a number (as another example of the particular number) obtained by adding one to the minimum number, and the controller 100 determines to use the separating position corresponding to a shorter one of the first and second completion times. The controller 100 at this time also sets the waiting times for the respective sheet groups corresponding to the separating position. It is noted that the particular number at least needs to be larger than or equal to the minimum number of the separating positions and smaller than or equal to a predetermined number that is larger than or equal to the minimum number. The predetermined number is preferably such a value that the number of patterns of separating positions for calculating the second completion time is not too large. In the present embodiment, the predetermined number is two. The predetermined number may be a value less than or equal to five. The present second embodiment differs from the first embodiment only in the determination processing. Thus, the determination processing will be explained principally. In the present embodiment, there will be next explained the case where the controller 100 receives a recording job indicating forty as the number of sheets P to be recorded.

In the determination processing, the controller 100 at SG1 calculates the first completion time on condition that the number of sheets P to be recorded is separated such that the number of separating positions becomes the minimum number. The controller 100 at SG1 executes processings similar to those at SF1-SF10 in the first embodiment. In the present embodiment, since the number of sheets P to be recorded is forty, the separation selected range is only the twentieth sheet P. That is, the number of separating positions is one. Thus, the position is set as the temporary separating position, so that the first sheet group containing the first to twentieth sheets P and the second sheet group containing the twenty-first to fortieth sheets P are set. The controller 100 extracts the waiting time for each sheet group in the same manner as in the first embodiment and stores each waiting time in association with the last page number of a corresponding one of the sheet groups. The controller 100 then calculates the first total waiting time. In the present embodiment, for example, the waiting time for the first sheet group is eight seconds, the waiting time for the second sheet group is six seconds, and the first total waiting time is fourteen seconds. In the case where the number of sheets P to be recorded is not equal to an integral multiple of the maximum sheet capacity of the holding mechanism 30, for example, the number of sheets P to be recorded is thirty, the controller 100 calculates the first total waiting time by executing the same processings as executed at SF1-SF10 in the first embodiment.

After executing the same processings as executed at SF1-SF10 in the first embodiment, the controller 100 at SG1 calculates the first completion time by adding up a conveying time, the shortest first total waiting time, and a transfer time. The conveying time is a length of time which is required for all the sheets P to be conveyed from the supply tray 3 to the holding mechanism 30 with image recording based on the recording job. The transfer time is obtained by multiplication of the number of transfers (i.e., the number of sheet groups) and a length of time required for the moving mechanism 40 to transfer the sheets P in a single sheet group from the holding mechanism 30 to the reception tray 4.

The controller 100 at SG2 calculates the second completion time on condition that the number of sheets P to be recorded is separated such that the number of separating positions becomes the particular number. At SG2, the controller 100 first sets the separation selected range. In the present embodiment, since the number of separating positions is two, as illustrated in FIG. 10, the number of different patterns of the separating position is 209. FIG. 10 illustrates arrangeable temporary separating positions for the first to thirty-ninth sheets P, with each first temporary separating position indicated as "T1", and each second temporary separating position as "T2". As illustrated in FIG. 10, in the case where the first temporary separating position is successively defined in order from the first sheet P to the nineteenth sheet P, the number of patterns of the second temporary separating position increases by one with shorter distance from the first temporary separating position to the nineteenth sheet P in the twentieth to thirty-ninth sheets P. That is, when the first temporary separating position is the first sheet P, the second temporary separating position may be any of the twentieth sheet P and the twenty-first sheet P. In other words, there are two patterns. The number of patterns of the second temporary separating position increases with decrease in distance of the first temporary separating position to the nineteenth sheet P one by one. When the first temporary separating position is the nineteenth sheet P, the second temporary separating position may be any of the twentieth to thirty-ninth sheets P. In other words, there are twenty patterns. As a result, the number of all the different patterns of the first and second temporary separating positions is 209.

The controller 100 calculates the waiting time for each of the sheet groups in each of all the 209 patterns and calculates the second total waiting time for each pattern. These second total waiting times are also calculated in the same processings as executed at SF5-SF10 in the first embodiment. As at SG1, the controller 100 then calculates the second completion time by adding up the conveying time, the shortest second total waiting time, and the transfer time. In the calculation of the second completion time, conditions of the second total waiting time and the transfer time are different from those at SG1. The transfer time increases with increase in the number of transfers.

The controller 100 at SG3 extracts a shorter one of the first completion time calculated at SG1 and the second completion time calculated at SG2. The controller 100 sets, as the separating position, the temporary separating position corresponding to the total waiting time used for the calculation of the extracted completion time. The waiting time for each sheet group for the temporary separating position is set as the waiting time for each sheet group in the current recording job.

Since the separating position and the waiting time are set in the above-described determination processing, when the same processings as executed at S3-S11 in the first embodiment are executed, the sheets P are at rest in the holding mechanism 30 for the waiting time set for each sheet group and transferred to the reception tray 4. Upon completion of the processing at S3, the flow ends.

In the printer according to the second embodiment, the controller 100 compares the first completion time and the second completion time with each other and sets the separating position and the waiting time for each sheet group such that a shorter one of the first completion time and the second completion time is employed. This processing can achieve the shortest completion time relating to the recording job, and it is possible to reduce the completion time while keeping the degree of curl of the sheets P to a degree less than or equal to a predetermined amount. It is noted that the same effects can be obtained by the same configuration as employed in the first embodiment.

In the first and second embodiments, the sheets P in the sheet group transferred from the holding mechanism 30 to the reception tray 4 may be curled with a height less than or equal to the allowable height of curl. However, the sheet group may be transferred from the holding mechanism 30 to the reception tray 4 after the sheets P are recovered to the state before generation of the curl. This modification can be achieved by changing the coefficient Ca relating to the relative position of the sheet P in the sheet group. Each of the individual waiting times in this modification is calculated in the same manner as in the above-described embodiments except for the coefficient Ca1 being different from that in the above-described embodiments. FIG. 17 illustrates the coefficient Ca1 in the present modification which is a coefficient relating to a relative position of the sheet P in the vertical direction in the sheet group in the holding mechanism 30. Also in the present modification, as illustrated in FIG. 17, the coefficient Ca1 increases with increase in the height position of the sheet.

In the present modification, the coefficient Ca1 is set with consideration in which the curl has been eliminated at the timing when the sheets P are transferred from the holding mechanism 30 to the reception tray 4. Thus, the coefficient Ca1 at each sheet position is larger than that in the above-described embodiments. This increase causes increase in the individual waiting time and the waiting time in the holding mechanism 30. The present modification also takes it consideration that when the individual waiting time is calculated based on the relative position of the sheet P, the development of the curl is suppressed by the weight of the upper sheet P in the holding mechanism 30. Since reduction in the recovery time of the curl in the holding mechanism 30 is taken into consideration, the sheet group can be transferred to the reception tray 4 at an earlier timing. Accordingly, the individual waiting time can be effectively reduced. The present modification does not take it into consideration that the development of the curl is suppressed by the weight of the upper sheet P on the reception tray 4. Thus, the sheet P needs to be kept waiting in the holding mechanism 30 until the curl is eliminated. In this modification, as in the above-described embodiments, the waiting time in the holding mechanism 30 can be effectively reduced. As a result, the completion time can be reduced while keeping the height of the curl of the sheets P to a height less than or equal to the allowable height of curl. In addition, since the sheets P transferred to the reception tray 4 are not curled, the sheets P with no curl can be provided to the user.

Figure 11:
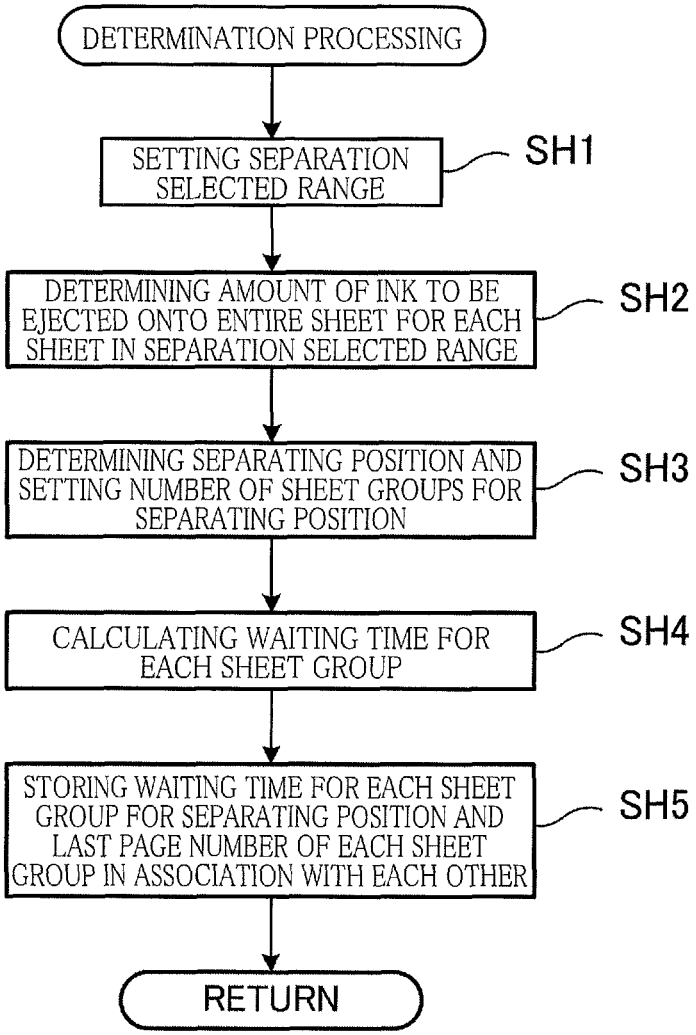
FIG. 11 is a flow chart illustrating a determination processing executed by the controller of the printer according to a third embodiment.
Figure 12:
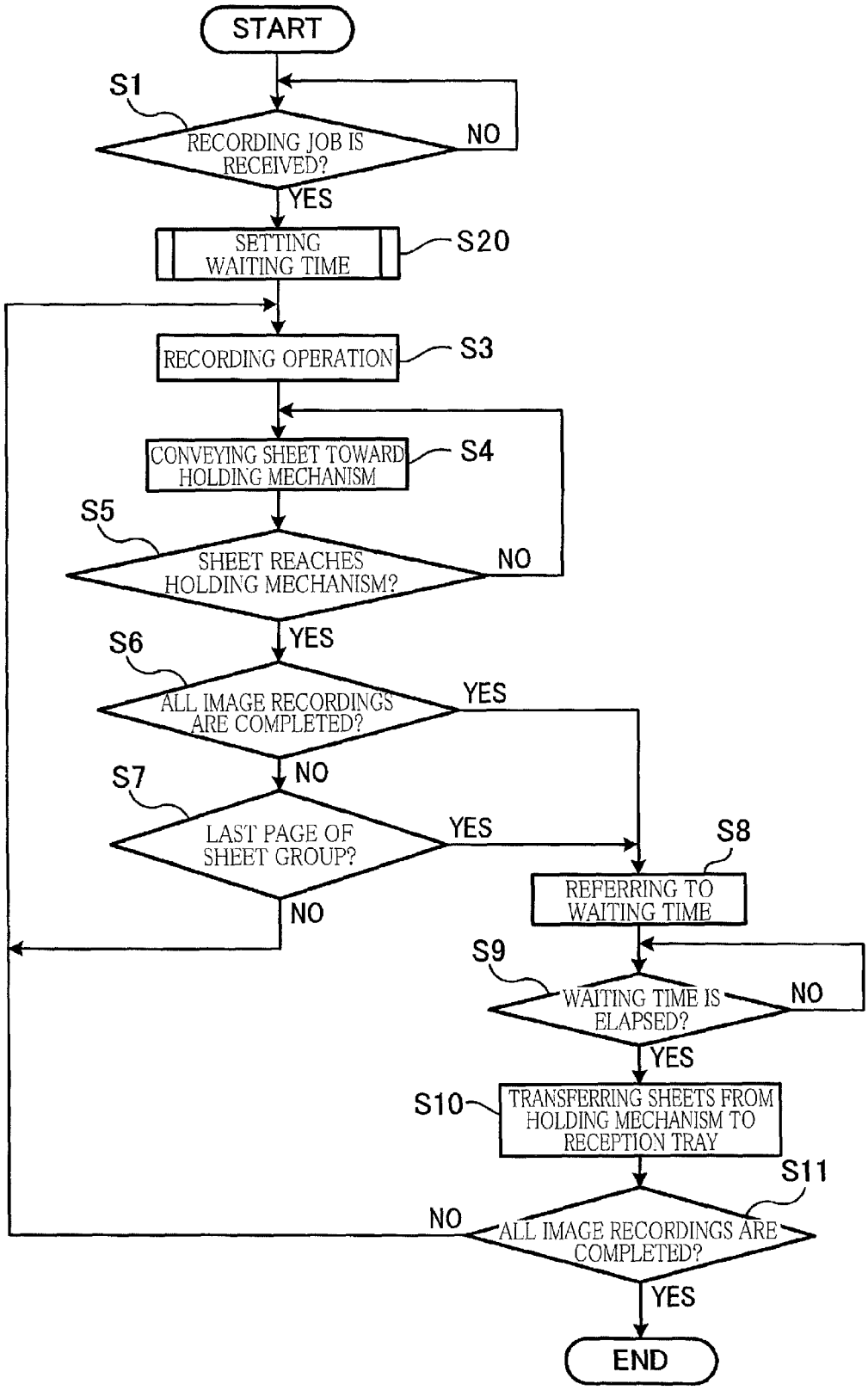
FIG. 12 is a flow chart illustrating processings executed by the controller of the printer illustrated in FIG. 1.

There will be next explained a printer according to a third embodiment with reference to FIG. 11. In the determination processing, the printer according to the present embodiment determines, as the separating position, one of the temporary separating positions, at which the number of separating positions is the minimum number (the particular number) as in the first embodiment and at which the smallest amount of ink is to be ejected onto one of the sheets P which is supported on the reception tray 4 at the uppermost position among the sheets P when the sheets P are transferred from the holding mechanism 30 to the reception tray 4. In this determination, the controller 100 also sets the waiting time for the sheet group corresponding to the determined separating position. The present third embodiment differs from the first embodiment only in the determination processing. Thus, the determination processing will be explained principally. In the present embodiment, there will be explained the case where the controller 100 has received a recording job indicating that the number of sheets P to be recorded is thirty.

In the determination processing, the controller 100 at SH1 sets the separation selected range on condition that the number of sheets P to be recorded is separated such that the number of separating positions becomes the minimum number. Also in the present embodiment, as in the first embodiment, since the number of sheets P to be recorded is thirty, and the maximum sheet capacity of the holding mechanism 30 is twenty, the number of separating positions is one, and the temporary separating positions are respectively set between the tenth to twenty-first sheets P of the sheets P to be recorded. Each of sheet groups defined by the temporary separating positions contains at least one sheet which is less than or equal to the maximum sheet capacity. The controller 100 sets, with respect to the separating position, the separation selected range which is the range of the sheets P from the tenth sheet to the twentieth sheet and which contains the temporary separating positions forming the sheet groups, in each of which the number of sheets P is less than or equal to the maximum sheet capacity.

After SH1, the controller 100 at SH2 determines an amount of ink to be ejected onto the entire sheet P for each of the sheets P in the separation selected range. Specifically, each of the sheets P in the separation selected range corresponds to the last page of the sheet group defined at each of the temporary separating positions and corresponds to the uppermost one of the sheets P contained in the sheet group and to be supported on the holding mechanism 30 and the reception tray 4. The controller 100 determines the amount of ink to be ejected onto the entire sheet P by referring to the image data of the recording job. More specifically, the controller 100 determines the ink amount for each of the areas A1-F5 on the sheet P based on the image data for each sheet P and adds up the determined ink amounts to determine the ink amount for each sheet P.

After SH2, the controller 100 at SH3 determines, as the separating position, the temporary separating position corresponding to the sheet P corresponding to the smallest one of the ink amounts determined at SH2 and sets the number of sheet groups for the separating position. That is, the controller 100 determines, as the separating position, the temporary separating position corresponding to the smallest amount of ink to be ejected onto the uppermost one of the sheets P in the holding mechanism 30 and the reception tray 4 among the plurality of temporary separating positions in the separation selected range. In the present embodiment, since the number of sheets P to be recorded is thirty, the number of sheet groups is two. Specifically, a first half of the sheet groups obtained by separating the sheets P at the temporary separating position is a first sheet group, and a second half of the sheet groups is a second sheet group. Also, in the present embodiment, the last page of each of the sheet groups is located at the uppermost position when each sheet group is transferred from the holding mechanism 30 to the reception tray 4.

After SH3, the controller 100 at SH4 calculates the waiting time for each of the sheet groups by multiplication of the reference waiting time and the coefficient Cb1 relating to the last page of each sheet group. It is noted that the reference waiting time in the present embodiment is set at ten seconds as in the first embodiment.

The coefficient Cb1, illustrated in FIG. 18, relates to the amount of ink to be ejected onto the sheet P. As illustrated in FIG. 18, the coefficient Cb1 increases with increase in the amount of ink to be ejected. Increase in the amount of ink to be ejected onto the sheet P increases a time required for the ink to penetrate the sheet P, which increases a length of time of development of the curl. In other words, decrease in the amount of ink to be ejected onto the sheet P decreases the time required for the ink to penetrate the sheet P, which reduces the time of development of the curl. The ink amount increases with increase in area on the sheet P onto which the ink is to be ejected and decreases with decrease in the area. In the present embodiment, it is assumed that the maximum amount of ink to be ejected onto the sheet P (i.e., a state in which ink is ejected on the entire sheet P) is 100%, and the coefficient Cb1 in this state is one. The coefficient Cb1 decreases with decrease in the amount of ink to be ejected (i.e., the area onto which the ink is ejected), to 80%, 60%, 40%, 20%, and 0%. It is noted that when the ink amount is 0%, the sheet P is not curled at the area, and accordingly the coefficient Cb1 is zero.

After SH4, the controller 100 at SH5 stores (i) the waiting time calculated at SH4 for each sheet group for the separating position and (ii) the last page number of each sheet group, into the RAM 100*c* in association with each other. The waiting time for each sheet group is set in this manner.

Since the separating position and the waiting time are set as described above in the determination processing, when processings similar to the processings S3-S11 in the first embodiment are executed, the sheets P in each of the sheet groups wait in the holding mechanism 30 for the waiting time set for a corresponding one of the sheet groups and are then transferred to the reception tray 4. Upon completion of the processing at SH5, the flow ends.

In the printer according to the third embodiment as described above, the sheet P onto which the smallest amount of ink is to be ejected in the separation selected range is determined as the separating position, and when the sheet group containing the sheet P is transferred to the reception tray 4, the sheet P determined as the separating position is positioned at the uppermost position. No sheet P is discharged onto the uppermost one of the sheets P supported on the reception tray 4. That is, the uppermost sheet P needs to be at rest in the holding mechanism 30 to prevent the uppermost sheet P from further curling due to the ejected ink to a height higher than the allowable height of curl.

In the present embodiment, the waiting time calculated based on the amount of ink to be ejected onto the sheet P serving as the separating position is set as the waiting time for the sheet group containing the sheet P. This processing can prevent the height of the curl of the sheet P as the separating position from exceeding the allowable height in the holding mechanism 30. Also, on the reception tray 4, at least one sheet P is placed on an upper side of each sheet P placed under the uppermost sheet P in the sheet group. Thus, the weight of the sheet P suppresses development of curl of the lower sheet P on the reception tray 4. As a result, the curl of the overall sheet group can be suppressed also on the reception tray 4. Also, the temporary separating position corresponding to the sheet P onto which a small amount of ink is to be ejected is set as the separating position, and the waiting time for the sheet group is calculated based on the ink amount, and accordingly the waiting time is also shortened. As in the first embodiment, in the present embodiment, the completion time relating to the recording job includes: the waiting time for which the sheets P in each sheet group are at rest in the holding mechanism 30; and the other times which are elapsed on the same condition for any of the separating positions. The other times include: a length of time in which all the sheets P are conveyed from the supply tray 3 to the holding mechanism 30 with image recording based on the recording job; and a length of time in which at least one sheet P is transferred from the holding mechanism 30 to the reception tray 4 for each of the sheet groups. Thus, in the case where the waiting time for the sheet group is shortened, the completion time relating to the recording job becomes shortest. Accordingly, the completion time can be reduced while keeping the height of the curl of the sheets P to a height less than or equal to the allowable height of curl.

The controller 100 at SH1 sets the number of separating positions to the particular number. This processing facilitates a process for determining the separating position and the waiting time, allowing the controller 100 to easily determine the separating position and the waiting time.

The controller 100 at SH1-SH3 determines, as the separating position, the temporary separating position at which the number of separating positions is the minimum number (the particular number) and the smallest amount of ink is to be ejected onto the uppermost one of the sheets P supported on the reception tray 4, among the plurality of temporary separating positions in the separation selected range. This processing can easily determine the separating position. Also, since the particular number is the minimum number, the process for determining the separating position is facilitated, allowing the controller 100 to easily determine the separating position.

The controller 100 at SH4 calculates the waiting time for each sheet group by multiplication of the reference waiting time and the coefficient Cb1 relating to the last page of each sheet group. The sheet P of the last page of each sheet group is placed at the uppermost position when each sheet group is transferred to the reception tray 4. As a result, the controller 100 determines the waiting time based on the amount of ink to be ejected onto the uppermost one of the sheets P supported on the reception tray 4. Accordingly, the waiting time in the holding mechanism 30 can be effectively reduced. Also, the coefficient Cb1 increases with increase in the amount of ink to be ejected. Accordingly, the waiting time can be calculated accurately.

As a modification, for each of the sheets P in the separation selected range, the controller 100 may calculate the ink amount for each of the areas A1-F5 by multiplying the ink amount for each of the areas A1-F5 in the first embodiment by the coefficient Cc relating to each of the areas A1-F5 and determine the largest one of the calculated ink amounts as the ink amount for the sheet P. In this modification, the controller 100 determines, as the separating position, the sheet P corresponding to the smallest one of the calculated ink amounts for the respective sheets P in the separation selected range. In the case of calculating the waiting time, the controller 100 may calculate the waiting time for each sheet group by multiplication of the reference waiting time and the coefficients Cb, Cc relating to the last page of each sheet group. This modification also achieves the same effects as achieved in the third embodiment. In addition, since the coefficient Cc for each of the areas A1-F5 is used for the multiplication to calculate the waiting time, the waiting time can be calculated accurately.

There will be next explained processings executed by the controller 100 in a fourth embodiment with reference to FIGS. 7 and 12-14B. The controller 100 repeats the routine illustrated in FIG. 12 while the power source of the printer 1 is ON.

This flow begins with S1 at which the controller 100 determines whether or not the controller 100 has received the recording job containing the image data which is transmitted from the external device. When the recording job is not received (S1: NO), this flow repeats the processing at S1. When the recording job is received (S1: YES), the controller 100 at S20 sets a waiting time. In the present embodiment, there will be explained the case where the controller 100 has received a recording job for recording images on a plurality of sheets P.

Figure 13:
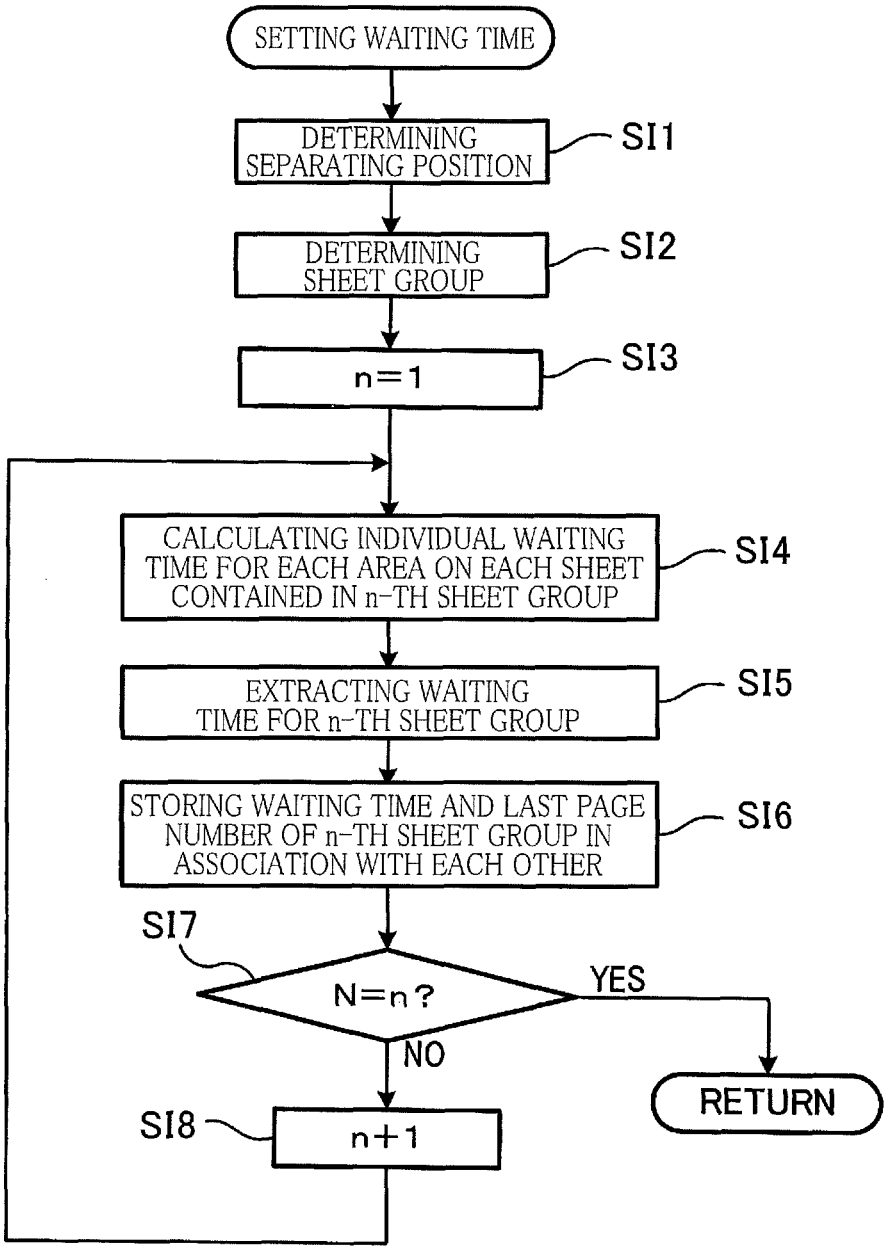
FIG. 13 is a flow chart illustrating a processing at S20 in FIG. 12 in a fourth embodiment.

In the processing at S20, as illustrated in FIG. 13, the controller 100 at SI1 determines a separating position for the number of sheets P to be recorded based on the current recording job. In the processing at SI1, when the number of sheets P to be recorded is less than or equal to the maximum sheet capacity of the holding mechanism 30, the controller 100 determines that no separating position is required, and when the number of sheets P to be recorded is greater than the maximum sheet capacity of the holding mechanism 30, the separating position or positions are determined for each maximum sheet capacity. The maximum sheet capacity of the holding mechanism 30 is twenty in the present embodiment. Thus, in the case where the number of sheets P to be recorded based on the recording job is thirty, for example, the separating position is set between the twentieth and twenty-first sheets P.

After SI1, the controller 100 at SI2 sets (i) the number of sheet groups obtained by separation using the separating position or positions determined at SI1 and (ii) the sheet or sheets P contained in each of the sheet groups. The number of sheet groups set in this processing is defined as N which is greater than the number of separating positions by one. That is, in the case where the separating position is one, the number of sheet groups is two. In the case where the number of sheets P to be recorded based on the recording job is thirty, for example, the sheets P to be recorded are separated or divided into a sheet group containing twenty sheets P and a sheet group containing ten sheets P. In the case where no separating position is determined, the number of sheet groups is one. After SI2, the controller 100 sets n to 1 at SI3. The variable n indicates the ordinal number of the sheet group.

After SI3, the controller 100 at SI4 calculates an individual waiting time for each of the areas A1-F5 on each of the sheets P contained in an n-th sheet group. That is, the controller 100 at SI4 calculates the individual waiting time by multiplying the reference waiting time by the three coefficients Ca, Cb, Cc for each of the areas A1-F5 on each sheet P. The reference waiting time is set at ten seconds in the present embodiment.

At SI4, the controller 100 first calculates the individual waiting time for each of the areas A1-F5 on the uppermost one of the sheets P supported on the reception tray 4. For example, in the case where the ink amount on the area A1 is 40%, four seconds are obtained as the individual waiting time for the area A1 by multiplication of 10 seconds as the reference waiting time, 1 as the coefficient Ca, 0.4 as the coefficient Cb, and 1 as the coefficient Cc ($10\times1\times0.4\times1$). It is noted that the amount of ink to be ejected onto each of the areas A1-F5 is calculated by the controller 100 referring to the image data contained in the recording job. The controller 100 calculates the individual waiting time for each of the areas A2-F5 in the same manner as that for the area A1. Examples of the individual waiting times (sec.) calculated in this manner are indicated in FIG. 7 with parentheses for the areas A1-F5. After the individual waiting times are calculated for all the areas A1-F5 on the uppermost one of the sheets P, the controller 100 similarly calculates the individual waiting time for each of the areas A1-F5 on each of the other sheets P contained in the n-th sheet group. In this calculation, the controller 100 calculates the individual waiting time for each of the areas A1-F5 on all the sheets P contained in the n-th sheet group. All the calculated individual waiting times are stored into the RAM 100*c*. In the calculation of the individual waiting time for each of all the areas A1-F5 on the sheets P contained in the n-th sheet group, the calculation may be performed for any of the areas A1-F5 on any of the sheets P first.

The controller 100 at SI5 extracts the waiting time for the n-th sheet group. Specifically, the controller 100 first extracts the individual waiting time for each of the sheets P contained in the n-th sheet group. That is, the controller 100 extracts the longest individual waiting time among the areas A1-F5 of the sheets P and determines the longest individual waiting time as the individual waiting time for each of the sheets P. For example, as illustrated in FIG. 7, eight seconds are the longest value on the uppermost one of the sheets P supported on the reception tray 4 and are determined as the individual waiting time for the sheet P. The controller 100 extracts the individual waiting time for the other sheets P in the same manner. FIG. 14A illustrates examples of the individual waiting times for each of the sheets P contained in the first sheet group. It is noted that FIG. 14A corresponds to the sheet group containing the twenty sheets P obtained by separation in the case where the number of sheets P to be recorded based on the recording job is thirty. The controller 100 then extracts the longest individual waiting time among the sheets P and determines the longest individual waiting time as the waiting time for the n-th sheet group. That is, the longest individual waiting time (i.e., eight seconds) among the individual waiting times in FIG. 14A is determined as the waiting time for the sheet group. As a modification, the controller 100 may extract the longest individual waiting time among the individual waiting times for the areas A1-F5 on all the sheets P contained in the n-th sheet group and determine the extracted longest individual waiting time as the waiting time for the n-th sheet group. This configuration can eliminate the need for extracting the individual waiting times for each of the sheets P in the n-th sheet group.

The controller 100 at SI6 stores, into the RAM 100*c*, the waiting time extracted at SI5 and the last page number of the n-th sheet group in association with each other. As a result, the waiting time for the n-th sheet group is set. FIG. 14B illustrates examples of the waiting times for the n-th sheet group (the sheet group containing the twenty sheets P in this example). The processings at SI4-SI6 are one example of a waiting-time setting processing.

After SI6, the controller 100 at SI7 determines whether the variable n of the n-th sheet group is equal to the set number of sheet groups N or not. When the number N set at SI2 is not equal to n (SI7: NO), the controller 100 has not finished extracting the waiting times for all the sheet groups. Thus, this flow goes to SI8 at which the controller 100 increments n by one, and this flow returns to SI4. That is, the controller 100 repeats the processings at SI4-SI6 by the number of sheet groups. FIG. 14B also illustrates examples of the waiting times in this case. FIG. 14B illustrates the waiting times for the sheet group containing the twenty sheets P and the sheet group containing the ten sheets P in the case where the number of sheets P to be recorded based on the recording job is thirty. On the other hand, when N is equal to n (SI7: YES), the waiting times for the respective sheet groups have been set, and this flow goes to S3.

Processings at S3-S10 are similar to those in the first embodiment, and an explanation of which is dispensed with. It is noted that the processing at S4 is one example of the conveyance processing in this embodiment. Also, in this embodiment, the controller 100 at S8 refers to one of the waiting times stored in the RAM 100*c*, as a current waiting time, which one waiting time is for the number of the last page corresponding to the most-recently recorded sheet P.

After S10, the controller 100 at S11 determines whether the recording operation has been performed for all the sheets P based on the recording job or not. When the recording operation has not been performed for all the sheets P (S11: NO), this flow goes to S3. When the recording operation has been performed for all the sheets P (S11: YES), this flow ends.

In the printer 1 according to the present embodiment as described above, when the plurality of sheets P contained in the sheet group are at rest in the holding mechanism 30, the height of curl of the sheets P can be less than or equal to the allowable height. The individual waiting time is calculated, for each of the areas A1-F5 on each sheet P contained in each sheet group, by multiplication of the reference waiting time and the three coefficients Ca, Cb, Cc. The calculation of the individual waiting time based on the relative position of the sheet P means that it is considered that development of the curl is suppressed due to the weight of the upper sheet P in both of the holding mechanism 30 and the reception tray 4. That is, at the timing when the height of the curl does not further increase to a height higher than the allowable height, the sheet group can be transferred from the holding mechanism 30 to the reception tray 4. Since the recovery time for recovering the curl can be reduced in the holding mechanism 30, the sheet group can be transferred to the reception tray 4 at an earlier timing. Accordingly, the individual waiting time can be effectively reduced. The controller 100 sets the longest one of the individual waiting times as the waiting time for the sheet group and causes the sheets P to wait in the holding mechanism 30 for the waiting time for each sheet group. Accordingly, the length of time required for the image-recorded sheets P to be transferred to the reception tray 4 can be reduced while suppressing the degree of curl of the sheets P.

The individual waiting time is calculated by multiplication of the reference waiting time and the three coefficients Ca, Cb, Cc. Thus, the controller 100 can easily calculate the individual waiting time. Also, since not only the coefficients Ca, Cb but also the coefficient Cc is used for the multiplication to calculate the individual waiting time, the individual waiting time can be calculated accurately. Furthermore, the coefficient Cc increases from the center (i.e., the inner region) of the sheet P to the edges (i.e., the outer region) of the sheet P. Thus, the individual waiting time can be calculated accurately.

The coefficient Cb increases with increase in the amount of ink to be ejected onto each of the areas A1-F5. Thus, the individual waiting time can be calculated accurately. The coefficient Ca increases with the higher height position of the sheet in the reception tray 4. As a result, the individual waiting time can be calculated accurately. That is, the number of sheets placed on the upper side of each sheet decreases with increase in the height position of the sheet, and an effect of suppressing the curl decreases with increase in the height position of the sheet. Since this decrease in the effect of suppressing the curl is taken into consideration using the coefficient Ca relating to the relative position of the sheet, the accuracy of the individual waiting time is improved.

In the above-described embodiments, there is a possibility that the sheets P in the sheet group transferred from the holding mechanism 30 to the reception tray 4 are curled with a height less than or equal to the allowable height of curl. However, the sheet group may be transferred from the holding mechanism 30 to the reception tray 4 after the sheets P are recovered to the state before generation of the curl. This modification can be achieved by changing the coefficient Ca relating to the relative position of the sheet P in the sheet group. Each of the individual waiting times in this modification is calculated in the same manner as in the above-described embodiments except for the coefficient Ca1 being different from that in the above-described embodiments. FIG. 17 illustrates the coefficient Ca1 in the present modification which is a coefficient relating to a relative position of the sheet P in the vertical direction in the sheet group in the holding mechanism 30. Also in the present modification, as illustrated in FIG. 17, the coefficient Ca1 increases with increase in the height position of the sheet.

In the present modification, the coefficient Ca1 is set with consideration in which the curl has been eliminated at the timing when the sheets P are transferred from the holding mechanism 30 to the reception tray 4. Thus, the coefficient Ca1 at each sheet position is larger than that in the above-described embodiments. This increase causes increase in the individual waiting time and the waiting time in the holding mechanism 30. The present modification also takes it consideration that when the individual waiting time is calculated based on the relative position of the sheet P, the development of the curl is suppressed by the weight of the upper sheet P in the holding mechanism 30. Since reduction in the recovery time of the curl in the holding mechanism 30 is taken into consideration, the sheet group can be transferred to the reception tray 4 at an earlier timing. Accordingly, the individual waiting time can be effectively reduced. The present modification does not take it into consideration that the development of the curl is suppressed by the weight of the upper sheet P on the reception tray 4. Thus, the sheet P needs to be kept waiting in the holding mechanism 30 until the curl is eliminated. As in the above-described embodiments, the controller 100 sets the longest one of the individual waiting times as the waiting time for the sheet group and causes the sheets P to wait in the holding mechanism 30 for the waiting time for each sheet group. Accordingly, the length of time required for the image-recorded sheets P to be transferred to the reception tray 4 can be reduced while suppressing the degree of curl of the sheets P. In addition, since the sheets P transferred to the reception tray 4 are not curled, the sheets P with no curl can be provided to the user.

As modifications of each embodiment described above, the moving mechanism may move the pair of restrainers 35 retaining the sheets P, outward in the main scanning direction and may cause pivotal movement of the pair of restrainers 35 retaining the sheets P such that inner edge portions of the pair of restrainers 35 in the main scanning direction are moved to positions located below outer edge portions of the pair of restrainers 35 in the main scanning direction. These modifications can also transfer the plurality of sheets P from the holding mechanism 30 to the reception tray 4.

While the embodiments have been described above, it is to be understood that the disclosure is not limited to the details of the illustrated embodiment, but may be embodied with various changes and modifications, which may occur to those skilled in the art, without departing from the spirit and scope of the disclosure. For example, while the controller 100 calculates the individual waiting time for each of all the sheets P contained in the n-th sheet group at SF5 in the first and second embodiments and their modifications and at SI4 in the fourth embodiment and its modifications, the controller 100 may calculate the individual waiting time for each area on two or more sheets P containing the uppermost one of the sheets P in the reception tray 4 or the holding mechanism 30. Also, the controller 100 may not calculate the individual waiting time for areas for which any of the coefficients Ca, Ca1, Cb, Cb1 is zero.

The holding mechanism may include only one of the pair of restrainers 35. In this configuration, the restrainer preferably includes: the horizontal portion 31*a* longer than the width of the sheet P in the main scanning direction; and the lower restraining members 32. Also, the holding mechanism may be constituted by a member corresponding to the horizontal portions 31*a* and two planar plates corresponding to the lower restraining members 32. In short, the holding mechanism at least needs to have: a first surface capable of supporting a first side (surface) of the sheet P in its thickness direction; and a second surface spaced apart from the first surface at a predetermined distance and opposed to a second side (surface) of the sheet P which is an opposite side of the sheet P from the first side. In this modification, the moving mechanism at least needs to be capable of moving at least the first surface such that the first surface is positioned selectively at one of a support position at which the first surface supports the sheet P and a non-support position at which the first surface does not support the sheet P.

The individual waiting time at least needs to be calculated based on the amount of ink to be ejected onto each area on the sheet P and the position of the sheet relative to the plurality of sheets P in the reception tray 4 or the holding mechanism 30. The coefficient Cc may not be used. The sheet P may be defined to have a single area which may be the entire surface of the sheet P.

The present disclosure is applicable to any of a line printer and a serial printer and applicable not only to the printer but also to devices such as a facsimile machine and a copying machine. Also, the present disclosure is applicable to any liquid ejection apparatus configured to eject liquid, other than the ink, from nozzles to perform the recording.

What is claimed is:

1. A liquid ejection apparatus, comprising:

a head configured to eject liquid;

a conveying mechanism configured to convey a recording medium on which an image is recorded with liquid ejected from the head;

a holding mechanism configured to accommodate at least one recording medium less than or equal to a specific number, the holding mechanism comprising: a first surface which supports the recording medium conveyed by the conveying mechanism; and a second surface spaced apart from and located above the first surface in a vertical direction, the holding mechanism being configured to hold the at least one recording medium between the first surface and the second surface;

a moving mechanism configured to move at least the first surface selectively to one of a support position at which the first surface supports the recording medium and a non-support position at which the first surface does not support the recording medium;

a reception tray disposed under the holding mechanism, the reception tray being configured to receive a plurality of recording media having been held by the holding mechanism in a state in which the plurality of recording media are stacked on one another on the reception tray, the reception tray comprising a support surface which supports a lowermost one of the plurality of recording media; and a controller configured to execute:

a separation processing in which the controller separates the plurality of recording media, which are greater in number than the specific number and are recorded throughout one recording job, into a plurality of recording-medium groups by setting at least one separation position such that the number of recording media in each of the plurality of recording-medium groups is less than or equal to the specific number;

a conveyance processing in which the controller controls the conveying mechanism to convey the recording medium to a space between the first surface and the second surface in each of the plurality of recording-medium groups;

an acquisition processing in which the controller acquires a waiting time for each of the plurality of recording-medium groups obtained in the separation processing, the waiting time being a period in which each of the plurality of recording-medium groups is to wait in the holding mechanism; and a moving processing in which the controller controls the moving mechanism to move the first surface from the support position to the non-support position when a time elapsed from a timing when each of the plurality of recording-medium groups has been conveyed to the holding mechanism reaches the waiting time for said each of the plurality of recording-medium groups.

2. The liquid ejection apparatus according to claim 1, wherein the controller is configured to determine at least one first separation position as the at least one separation position in the separation processing, wherein each of the at least one first separation position is one of a plurality of settable positions different from each other in a range in which each of the at least one separation position is settable, and wherein when the at least one first separation position is determined as the at least one separation position, a total time is shortest among the plurality of settable positions, and the total time is a sum of respective waiting times of the plurality of recording-medium groups corresponding to each of the plurality of settable positions.

3. The liquid ejection apparatus according to claim 2, wherein the controller is configured to execute the separation processing by setting the number of the at least one separation position for the plurality of recording media, to a particular number greater than or equal to a minimum number determined by (i) the specific number and (ii) the number of the plurality of recording media.

4. The liquid ejection apparatus according to claim 3, wherein the particular number is the minimum number.

5. The liquid ejection apparatus according to claim 2, wherein the controller is configured to execute the separation processing by setting the number of the at least one separation position for the plurality of recording media, to a particular number greater than or equal to a minimum number determined by (i) the specific number and (ii) the number of the plurality of recording media, and wherein the controller is configured to identify the at least one first separation position such that a smallest amount of liquid is to be ejected, among the plurality of settable positions, onto an uppermost recording medium in the holding mechanism in each of the plurality of recording-medium groups corresponding to each of the plurality of settable positions.

6. The liquid ejection apparatus according to claim 5, wherein the controller is configured to, in the acquisition processing, acquire the waiting time based on the amount of liquid to be ejected onto the uppermost recording medium in each of the plurality of recording-medium groups.

7. The liquid ejection apparatus according to claim 6, wherein the waiting time increases with increase in the amount of liquid to be ejected onto the recording medium.

8. The liquid ejection apparatus according to claim 2, wherein the controller is configured to execute the separation processing by setting the number of the at least one separation position for the plurality of recording media, to a particular number greater than or equal to a minimum number determined by (i) the specific number and (ii) the number of the plurality of recording media, and wherein the controller is configured to, for each of at least one recording medium containing an uppermost recording medium in the holding mechanism in each of the plurality of recording-medium groups corresponding to each of the plurality of settable positions, determine an individual waiting time for each of at least one area defined on each of the recording medium, based on (a) an amount of liquid to be ejected onto each of the at least one area and (b) a relative position of each of at least one recording medium in one of the holding mechanism and the reception tray relative to a corresponding one of the plurality of recording-medium groups, wherein the controller is configured to determine a longest individual waiting time for each of the plurality of recording-medium groups, and the longest individual waiting time is a longest one of the individual waiting times in each of the plurality of recording-medium groups, and wherein the controller is configured to identify the at least one first separation position such that a sum of the longest individual waiting times is shortest.

9. The liquid ejection apparatus according to claim 8, wherein the controller is configured to, in the acquisition processing, acquire the longest individual waiting time for the at least one first separation position at which the longest individual waiting time is shortest among the plurality of settable positions.

10. The liquid ejection apparatus according to claim 8, wherein the controller is configured to, in the separation processing, determine the individual waiting time by multiplication of a value corresponding to a set reference waiting time, a value corresponding to the amount of liquid to be ejected onto each of the at least one area, and a value corresponding to the relative position of each of the recording media relative to a corresponding one of the plurality of recording-medium groups.

11. The liquid ejection apparatus according to claim 10, wherein the value corresponding to the amount of liquid to be ejected onto each of the at least one area increases with increase in the amount of liquid to be ejected onto each of the at least one area.

12. The liquid ejection apparatus according to claim 10, wherein the value corresponding to the relative position of each of the recording media relative to the corresponding one of the plurality of recording-medium groups increases with increase in height of the relative position of each of the recording media relative to the corresponding one of the plurality of recording-medium groups.

13. The liquid ejection apparatus according to claim 10, wherein the controller is configured to, in the separation processing, determine the individual waiting time by further multiplying a value determined for each of the at least one area and corresponding to ease of curl generated due to ejection of the liquid, by the value obtained by the multiplication.

14. The liquid ejection apparatus according to claim 13, wherein the at least one area comprises a plurality of areas defined on a region extending from a center to edges of the recording medium, and wherein the value corresponding to the ease of curl increases with decrease in distance from the at least one area to the edge.

15. The liquid ejection apparatus according to claim 1, wherein the controller is configured to, in the acquisition processing, perform:

determining, for each of at least one recording medium containing an uppermost recording medium in the holding mechanism in each of the plurality of recording-medium groups, an individual waiting time for each of at least one area defined on each of the recording medium, based on (a) an amount of liquid to be ejected onto each of the at least one area and (b) a relative position of each of at least one recording medium in one of the holding mechanism and the reception tray relative to a corresponding one of the plurality of recording-medium groups; and acquiring, as the waiting time, a longest one of the individual waiting times in each of the plurality of recording-medium groups.

16. The liquid ejection apparatus according to claim 15, wherein the controller is configured to, in the acquisition processing, determine the individual waiting time by multiplication of a value corresponding to a set reference waiting time, a value corresponding to the amount of liquid to be ejected onto each of the at least one area, and a value corresponding to the relative position of each of the recording media relative to a corresponding one of the plurality of recording-medium groups.

17. The liquid ejection apparatus according to claim 16, wherein the value corresponding to the amount of liquid to be ejected onto each of the at least one area increases with increase in the amount of liquid to be ejected onto each of the at least one area.

18. The liquid ejection apparatus according to claim 16, wherein the controller is configured to, in the acquisition processing, determine the individual waiting time by further multiplying a value determined for each of the at least one area and corresponding to ease of curl generated due to ejection of the liquid, by the value obtained by the multiplication.

19. The liquid ejection apparatus according to claim 18, wherein the at least one area comprises a plurality of areas defined on a region extending from a center to edges of the recording medium, and wherein the value corresponding to the ease of curl increases with decrease in distance from the at least one area to the edge.

20. The liquid ejection apparatus according to claim 1, wherein the value corresponding to the relative position of each of the recording media relative to the corresponding one of the plurality of recording-medium groups increases with increase in height of the relative position of each of the recording media relative to the corresponding one of the plurality of recording-medium groups.

* * * * *